US011549337B2

(12) United States Patent
Konduc et al.

(10) Patent No.: US 11,549,337 B2
(45) Date of Patent: Jan. 10, 2023

(54) MULTI-WELL BOP CELLAR TRAILER

(71) Applicant: NOV Canada ULC, Calgary (CA)

(72) Inventors: Kameron Wayne Konduc, Edmonton (CA); Randy Steven Stoik, Leduc County (CA); Roman Konowalec, Edmonton (CA); Jonathon Douglas Callaghan, Edmonton (CA); Li Liu, Edmonton (CA); David Frederick Chalus, Edmonton (CA)

(73) Assignee: NOV CANADA ULC, Calgary (CA)

( * ) Notice: Subject to any disclaimer, the term of this patent is extended or adjusted under 35 U.S.C. 154(b) by 0 days.

(21) Appl. No.: 16/948,994

(22) Filed: Oct. 8, 2020

(65) Prior Publication Data

US 2021/0025263 A1 Jan. 28, 2021

Related U.S. Application Data

(62) Division of application No. 15/451,968, filed on Mar. 7, 2017, now Pat. No. 10,822,924.

(Continued)

(51) Int. Cl.
*E21B 41/00* (2006.01)
*E21B 7/02* (2006.01)

(Continued)

(52) U.S. Cl.
CPC ..... *E21B 41/00* (2013.01); *E04B 1/34336* (2013.01); *E21B 7/02* (2013.01); *E21B 33/06* (2013.01); *E21B 15/00* (2013.01)

(58) Field of Classification Search
CPC . E21B 41/00; E21B 7/02; E21B 33/06; E21B 15/00; E04B 1/34336; E04B 1/343
See application file for complete search history.

(56) References Cited

U.S. PATENT DOCUMENTS 295,172 A 3/1884 Hill
1,557,070 A 10/1925 Logue (Continued)

FOREIGN PATENT DOCUMENTS

CA 3016910 A1 9/2017
CN 101476312 A 7/2009

(Continued)

OTHER PUBLICATIONS

"Ackerman steering geometry", Wikipedia, [Online] Retrieved from the Internet: <https://en.wikipedia.org/wiki/Ackermann_steering_geometry>, (Accessed Jan. 11, 2017), 3 pgs.

(Continued)

*Primary Examiner* — Yong-Suk (Philip) Ro
(74) *Attorney, Agent, or Firm* — Schwegman Lundberg & Woessner, P.A.

(57) ABSTRACT

A drilling rig may include a detachable, modular cellar arranged beneath a drill floor of the drilling rig. The cellar may be or include a cellar trailer and it may also be configured to house drilling equipment, such as well head equipment and/or one or more blowout preventers. The cellar trailer may provide work areas, such that the well head equipment may be prepared, tested, or generally operated within the cellar trailer. The cellar trailer may additionally be configured to provide stiffening support to the drill floor in order to mitigate deflection of the drill floor during drilling operations. The stiffening support may be provided by a shear wall extending from the cellar trailer. The cellar trailer may be towable. The cellar trailer may additionally be skiddable and/or walkable.

12 Claims, 34 Drawing Sheets

Related U.S. Application Data

(60) Provisional application No. 62/304,674, filed on Mar. 7, 2016.

(51) Int. Cl.

| | |
|---|---|
| ***E04B 1/343*** | (2006.01) |
| ***E21B 33/06*** | (2006.01) |
| *E21B 15/00* | (2006.01) |

(56) References Cited

U.S. PATENT DOCUMENTS 2,420,803 A 5/1947 Tobin
2,657,017 A 10/1953 Curtis
2,663,375 A 12/1953 Caldwell
2,781,108 A 2/1957 Selberg et al.
3,063,509 A 11/1962 Guier
3,099,323 A 7/1963 Kelley
3,156,328 A 11/1964 Bender
3,228,151 A 1/1966 Woolslayer et al.
3,271,915 A 9/1966 Woolslayer et al.
3,327,997 A 6/1967 Howard
3,333,377 A 8/1967 Woolslayer et al.
3,421,596 A 1/1969 Christensen
3,477,235 A 11/1969 Branham et al.
3,483,933 A 12/1969 Dyer et al.
3,502,166 A 3/1970 Christenson et al.
3,774,780 A 11/1973 Buffington
3,807,109 A 4/1974 Jenkins et al.
3,828,513 A 8/1974 Vanderklaauw
3,911,980 A 10/1975 Mccoll
3,922,825 A 12/1975 Eddy et al.
3,942,593 A 3/1976 Reeve, Jr. et al.
3,949,818 A 4/1976 Russell
3,977,542 A 8/1976 Stolzer
4,068,487 A 1/1978 Pease et al.
4,081,932 A 4/1978 Armstrong
4,128,229 A 12/1978 Elliston
4,135,340 A 1/1979 Cox et al.
4,269,395 A 5/1981 Newman et al.
4,290,495 A 9/1981 Elliston
4,324,077 A 4/1982 Woolslayer
4,336,840 A 6/1982 Bailey
4,366,650 A 1/1983 Patterson
4,375,241 A 3/1983 Gallon
4,375,892 A 3/1983 Jenkins et al.
4,387,814 A 6/1983 Beduhn et al.
4,421,447 A 12/1983 Gudgel et al.
4,587,778 A 5/1986 Woolslayer et al.
4,823,870 A 4/1989 Sorokan
4,831,795 A 5/1989 Sorokan
4,837,992 A 6/1989 Hashimoto
4,885,893 A 12/1989 Wasterval, Jr. et al.
5,216,867 A 6/1993 Wasterval, Jr. et al.
5,407,302 A 4/1995 Springett et al.
5,492,436 A 2/1996 Suksumake
5,954,453 A 9/1999 Thomas
5,997,217 A 12/1999 Verret
6,045,297 A 4/2000 Voorhees et al.
6,054,829 A 4/2000 Young et al.
6,141,870 A 11/2000 Mcdermott et al.
6,148,940 A 11/2000 Hokanson et al.
6,171,027 B1 1/2001 Blankestijin
6,234,527 B1 5/2001 Poulin et al.
6,286,615 B1 9/2001 Bitelli
6,412,576 B1 7/2002 Meiners
6,474,926 B2 11/2002 Weiss
6,634,436 B1 10/2003 Desai
6,729,804 B1 5/2004 Roodenburg et al.
6,994,171 B2 2/2006 Orr et al.
6,997,647 B2 2/2006 Bennett, Jr. et al.
7,182,163 B1 2/2007 Gipson
7,308,953 B2 * 12/2007 Barnes ..... E21B 7/02 175/203
7,360,589 B2 4/2008 Moncus et al.
7,410,326 B2 8/2008 Morrison et al.
7,584,809 B1 9/2009 Flud
7,624,831 B2 12/2009 Orr et al.
7,765,749 B2 8/2010 Palidis
7,931,076 B2 4/2011 Ditta et al.
7,950,478 B2 5/2011 Terry
8,047,303 B2 11/2011 Donnally et al.
8,287,212 B2 10/2012 Roper
8,468,753 B2 6/2013 Donnally et al.
8,516,751 B2 8/2013 Konduc et al.
8,549,815 B2 10/2013 Donnally et al.
8,555,564 B2 10/2013 Wasterval
8,556,003 B2 10/2013 Souchek
8,875,911 B2 * 11/2014 Donnally ..... E21B 15/00 212/176
9,091,125 B2 7/2015 Konduc et al.
9,091,126 B2 7/2015 Thiessen et al.
9,109,399 B2 8/2015 Murr et al.
9,212,778 B2 12/2015 Winter
9,463,833 B2 10/2016 Smith et al.
9,488,014 B2 11/2016 Sparkman et al.
9,797,196 B2 * 10/2017 Taggart ..... E21B 7/022
RE46,723 E 2/2018 Smith et al.
9,926,719 B2 3/2018 Reddy et al.
10,293,854 B2 5/2019 Nguyen et al.
10,471,986 B2 11/2019 Nguyen et al.
10,822,924 B2 11/2020 Konduc et al.
11,021,186 B2 6/2021 Nguyen et al.
2002/0185319 A1 12/2002 Smith
2003/0102166 A1 6/2003 Jortveit
2003/0147726 A1 8/2003 Tolmon et al.
2003/0172599 A1 9/2003 Frink
2004/0151549 A1 8/2004 Roodenburg et al.
2004/0211572 A1 10/2004 Orr et al.
2004/0211598 A1 10/2004 Palidis
2004/0240973 A1 12/2004 Andrews et al.
2006/0180564 A1 8/2006 Keppel
2007/0272762 A1 11/2007 Click et al.
2008/0257607 A1 10/2008 Winter
2009/0000218 A1 1/2009 Lee et al.
2009/0188677 A1 7/2009 Ditta et al.
2009/0283324 A1 * 11/2009 Konduc ..... A61P 9/00 175/57
2009/0321135 A1 12/2009 Vora
2010/0150660 A1 6/2010 Nadarajah et al.
2010/0260555 A1 10/2010 Foo et al.
2010/0303586 A1 12/2010 Hankins et al.
2011/0072737 A1 3/2011 Wasterval
2011/0079568 A1 * 4/2011 Mau ..... B66C 23/80 212/296
2011/0114386 A1 5/2011 Souchek
2011/0280104 A1 11/2011 Mcclung, III
2012/0047820 A1 3/2012 Donnally et al.
2012/0138327 A1 6/2012 Sorokan et al.
2012/0201632 A1 8/2012 Yater et al.
2012/0304553 A1 12/2012 Konduc et al.
2013/0168516 A1 7/2013 Winter
2013/0180186 A1 * 7/2013 Konduc ..... E21B 7/023 52/119
2013/0269268 A1 10/2013 Thiessen et al.
2013/0305632 A1 11/2013 Rivera, Sr. et al.
2013/0340572 A1 12/2013 Flusche
2013/0340998 A1 12/2013 Flusche
2013/0341036 A1 12/2013 Flusche
2014/0041855 A1 2/2014 Rodgers
2014/0090333 A1 4/2014 Vogt
2014/0158342 A1 6/2014 Smith et al.
2014/0259985 A1 9/2014 Petrello et al.
2014/0262518 A1 9/2014 Reddy et al.
2014/0262519 A1 9/2014 Petrello et al.
2014/0262520 A1 9/2014 Petrello et al.
2014/0263685 A1 9/2014 Yustus et al.
2014/0270974 A1 9/2014 Seng et al.
2014/0270975 A1 9/2014 Seng et al.
2014/0331570 A1 11/2014 Fullerton et al.
2015/0014952 A1 1/2015 Morikawa
2015/0090450 A1 4/2015 Thiessen
2015/0122558 A1 5/2015 Van Raden
2015/0152690 A1 6/2015 Sorokan et al.
2015/0184466 A1 7/2015 Rivera, Sr. et al.

(56) References Cited

U.S. PATENT DOCUMENTS

| | | | |
|---|---|---|---|
| 2015/0218891 | A1 | 8/2015 | Padira et al. |
| 2015/0300038 | A1 | 10/2015 | Thiessen et al. |
| 2016/0052441 | A1 | 2/2016 | Korach |
| 2016/0090788 | A1 | 3/2016 | Niemczyk |
| 2016/0369523 | A1 | 12/2016 | Konduc et al. |
| 2017/0081924 | A1 | 3/2017 | Smith et al. |
| 2017/0241126 | A1 | 8/2017 | Konduc et al. |
| 2017/0254181 | A1 | 9/2017 | Konduc et al. |
| 2018/0093705 | A1 | 4/2018 | Nguyen et al. |
| 2018/0093706 | A1 | 4/2018 | Nguyen et al. |
| 2019/0233006 | A1 | 8/2019 | Nguyen et al. |
| 2021/0062595 | A1 | 3/2021 | Rochon et al. |
| 2021/0172260 | A1 | 6/2021 | Konduc et al. |
| 2022/0065048 | A1 | 3/2022 | Reddy et al. |

FOREIGN PATENT DOCUMENTS

| | | | |
|---|---|---|---|
| CN | 102536267 | A | 7/2012 |
| RU | 1770509 | A1 | 10/1992 |
| RU | 81516 | U1 | 3/2009 |
| RU | 96904 | U1 | 8/2010 |
| RU | 137053 | U1 | 1/2014 |
| SU | 1461858 | A1 | 2/1989 |
| SU | 1686052 | A1 | 10/1991 |
| WO | WO-2004094762 | A2 | 11/2004 |
| WO | WO-2008114064 | A1 | 9/2008 |
| WO | WO-2009002189 | A1 | 12/2008 |
| WO | WO-2010132174 | A1 | 11/2010 |
| WO | WO-2017155950 | A1 | 9/2017 |
| WO | WO-2018064746 | A1 | 4/2018 |
| WO | WO-2020028969 | A1 | 2/2020 |

OTHER PUBLICATIONS

"U.S. Appl. No. 15/285,946, Non Final Office Action dated Dec. 11, 2018", 8 pgs.
"U.S. Appl. No. 15/285,946, Notice of Allowance dated Jul. 9, 2019", 5 pgs.
"U.S. Appl. No. 15/285,946, Response filed Sep. 5, 2018 to Restriction Requirement dated Jul. 5, 2018", 6 pgs.
"U.S. Appl. No. 15/285,946, Response filed Mar. 11, 2019 to Non-Final Office Action dated Dec. 11, 2018", 8 pgs.
"U.S. Appl. No. 15/285,946, Restriction Requirement dated Jul. 5, 2018", 6 pgs.
"U.S. Appl. No. 15/349,661, Notice of Allowance dated Jan. 3, 2019", 8 pgs.
"U.S. Appl. No. 15/349,661, Response filed Oct. 26, 2018 to Restriction Requirement dated Aug. 28, 2018", 6 pgs.
"U.S. Appl. No. 15/349,661, Restriction Requirement dated Aug. 28, 2018", 5 pgs.
"U.S. Appl. No. 15/451,968, Non Final Office Action dated Sep. 10, 2018", 8 pgs.
"U.S. Appl. No. 15/451,968, Notice of Allowance dated Aug. 11, 2020", 7 pgs.
"U.S. Appl. No. 15/451,968, Preliminary Amendment filed Sep. 5, 2018", 5 pgs.
"U.S. Appl. No. 15/451,968, Response filed May 6, 2020 to Restriction Requirement dated Mar. 6, 2020", 5 pgs.
"U.S. Appl. No. 15/451,968, Response filed Nov. 18, 2019 to Restriction Requirement dated Sep. 18, 2019", 6 pgs.
"U.S. Appl. No. 15/451,968, Response filed Dec. 10, 2018 to Non Final Office Action dated Sep. 10, 2018", 10 pgs.
"U.S. Appl. No. 15/451,968, Response filed Jun. 5, 2019 to Restriction Requirement dated Apr. 5, 2019", 7 pgs.
"U.S. Appl. No. 15/451,968, Restriction Requirement dated Mar. 6, 2020", 6 pgs.
"U.S. Appl. No. 15/451,968, Restriction Requirement dated Apr. 5, 2019", 6 pgs.
"U.S. Appl. No. 15/451,968, Restriction Requirement dated Sep. 18, 2019", 6 pgs.
"U.S. Appl. No. 15/451,968, Supplemental Notice of Allowability dated Sep. 30, 2020", 4 pgs.
"U.S. Appl. No. 16/382,961, Non Final Office Action dated May 14, 2020", 7 pgs.
"U.S. Appl. No. 16/382,961, Response filed Aug. 10, 2020 to Non Final Office Action dated May 14, 2020", 7 pgs.
"Axles & Suspension Wheeled Moving System", Columbia Industries, [Online] Retrieved from the Internet: <http://www.joomag.com/magazine/columbiaindustries/0320299001391629028>, (Accessed Jan. 11, 2017), 4 pgs.
"Axles and Suspension", Columbia Industries, [Online] Retrieved from the Internet: <http://www.columbiacorp.com/axlesandsuspension.php>, (Mar. 17, 2016), 2 pgs.
"*Blue Calypso, LLC* v. *Groupon, Inc.*", CAFC, (Mar. 1, 2016), 46 pgs.
"Canadian Application Serial No. 3,016,910, Voluntary Amendment filed Jul. 8, 2019", 13 pgs.
"Entro Heavy Haul", Entro Industries, [Online] Retrieved from the Internet: <https://entro-eng.com/products/heavy-haul/heavy-haul-overview/>, (Accessed Jan. 11, 2017), 2 pgs.
"Entro Industries Homepage", [Online] Retrieved from the Internet: <https://entroeng.com/>, (Accessed Jan. 18, 2017), 2 pgs.
"European Application Serial No. 12791970.2, Extended European Search Report dated Sep. 2, 2015", 8 pgs.
"European Application Serial No. 12791970.2, Response filed Mar. 9, 2016 to Extended European Search Report dated Sep. 2, 2015", 32 pgs.
"In re Wolfensperger", 302 F.2d 950 (CCPA 1962), (May 18, 1962), 8 pgs.
"International Application Serial No. PCT/CA2012/000510, Response filed Mar. 14, 2013 to Written Opinion dated Aug. 24, 2012", 4 pgs.
"International Application Serial No. PCT/CA2012/000510, Written Opinion dated Aug. 24, 2012", 3 pgs.
"International Application Serial No. PCT/CA2015/000432, International Search Report dated Sep. 24, 2015", 3 pgs.
"International Application Serial No. PCT/CA2015/000432, Written Opinion dated Sep. 24, 2015", 5 pgs.
"International Application Serial No. PCT/CA2016/000229, International Search Report dated Oct. 26, 2016", 3 pgs.
"International Application Serial No. PCT/CA2016/000229, Written Opinion dated Oct. 26, 2016", 5 pgs.
"International Application Serial No. PCT/CA2017/000215, International Preliminary Report on Patentability dated Jan. 21, 2019", 5 pgs.
"International Application Serial No. PCT/CA2017/000215, International Search Report dated Jan. 9, 2018", 4 pgs.
"International Application Serial No. PCT/CA2017/000215, Written Opinion dated Jan. 9, 2018", 6 pgs.
"International Application Serial No. PCT/CA2019/000114, Article 34 Amendments filed Jun. 1, 2020", 8 pgs.
"International Application Serial No. PCT/CA2019/000114, International Search Report dated Nov. 20, 2019", 3 pgs.
"International Application Serial No. PCT/CA2019/000114, Written Opinion dated Nov. 20, 2019", 5 pgs.
"International Application Serial No. PCT/US2014/037431, International Search Report dated Oct. 7, 2014", 2 pgs.
"International Application Serial No. PCT/US2014/037431, Written Opinion dated Oct. 7, 2014", 6 pgs.
"International Application Serial No. PCT/US2016/019507, International Search Report dated Dec. 21, 2016", 6 pgs.
"International Application Serial No. PCT/US2016/019507, Written Opinion dated Dec. 21, 2016", 9 pgs.
"International Application Serial No. PCT/US2017/021095, International Preliminary Report on Patentability dated Sep. 20, 2018", 11 pgs.
"International Application Serial No. PCT/US2017/021095, International Search Report dated Jun. 12, 2017", 5 pgs.
"International Application Serial No. PCT/US2017/021095, Written Opinion dated Jun. 12, 2017", 9 pgs.
"Nabors Oil Rig Move", YouTube, [Online] Retrieved from the Internet : <https://www.youtube.com/watch?v=T4ELOeh6R6M>, (Oct. 22, 2008), 2 pgs.

(56) References Cited

OTHER PUBLICATIONS

"National Oilwell Varco Elevator/Substructure/Setback Cross-Section drawing", (Jul. 24, 1979), 1 pg.
"National Oilwell Varco Mast & Substructure Erection Sequence drawing", (Sep. 15, 1979), 1 pg.
"Photograph of Uralmesh rig", (Jul. 2014), 1 pg.
"Photographs of typical Uralmesh train rig", (Sep. 2012), 2 pgs.
"Pin-on Walkers for Ideal® Rigs", Entro Industries, [Online] Retrieved from the Internet : <https://entro-eng.com/products/walking-systems/ideal-pin-on-walkers/>, (Accessed Jan. 11, 2017), 2 pgs.
"Steering", Wikipedia, [Online] Retrieved from the Internet : <https://en.wikipedia.org/wiki/Steering>, (Accessed Jan. 11, 2017), 12 pgs.
U.S. Appl. No. 15/285,946, U.S. Pat. No. 10,471,986, filed Oct. 5, 2016, Movable Rig and Steering System.
U.S. Appl. No. 15/349,661, U.S. Pat. No. 10,293,854, filed Nov. 11, 2016, Movable Rig and Steering Systems.
U.S. Appl. No. 16/382,961, filed Apr. 12, 2019, Movable Rig and Steering System.
U.S. Appl. No. 15/451,968, filed Mar. 7, 2017, Multi-Well Bop Cellar Trailer.
U.S. Appl. No. 16/557,644, filed Aug. 30, 2019, Cuttings Processing Unit.
"U.S. Appl. No. 16/382,961, Final Office Action dated Nov. 12, 2020", 8 pgs.
"U.S. Appl. No. 16/382,961, Notice of Allowance dated Jan. 28, 2021", 5 pgs.
"U.S. Appl. No. 16/382,961, Response filed Jan. 13, 2021 to Final Office Action dated Nov. 12, 2020", 6 pgs.
"U.S. Appl. No. 16/557,644, Response filed May 2, 2022 to Restriction Requirement dated Mar. 1, 222", 7 pgs.
"U.S. Appl. No. 16/557,644, Restriction Requirement dated Mar. 1, 2022", 5 pgs.
"U.S. Appl. No. 17/250,576, Non Final Office Action dated Mar. 2, 2022", 15 pgs.
"U.S. Appl. No. 17/250,576, Notice of Allowance dated Jun. 8, 2022", 8 pgs.
"U.S. Appl. No. 17/250,576, Response filed Jun. 2, 2022 to Non Final Office Action dated Mar. 2, 2022", 10 pgs.

* cited by examiner

MULTI-WELL BOP CELLAR TRAILER

CROSS-REFERENCE TO RELATED APPLICATIONS

The present application is a divisional of U.S. patent application Ser. No. 15/451,968, which claims priority to U.S. Provisional Patent Application No. 62/304,674, filed on Mar. 7, 2016, entitled MULTI WELL BOP CELLAR TRAILER, the content of each of which are hereby incorporated by reference herein in their entirety.

FIELD OF THE INVENTION

The present application is generally directed to drilling rig assemblies. Particularly, the present disclosure relates to drilling rig assemblies having a modular, detachable cellar trailer. More particularly, the present disclosure relates to a modular, detachable drilling rig cellar trailer configured to house drilling equipment during roading and drilling operations.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Rigs drilling in the high Arctic may include sealed units to retain heat during drilling operations and rig moves. These rigs may move as a convoy of trailers towed by trucks and self-propelled units as they move between drilling pads in the high Arctic. The typical rig move between pads may be several hundred yards or several miles. The complete rig may also move from well to well on the pad during drilling operations. During rig moves, the loads may be maintained below the tire capacity, bridge capacity, ice road capacity, or other limiting factors. Arctic wells may be drilled to depths of up to or exceeding 35,000 feet in some cases.

Drilling to great depths may require relatively large drilling rigs and relatively heavy equipment. For example, a relatively large wellhead Christmas tree and blowout preventer may be needed. These devices can add hundreds of thousands of pounds to the drill rig, and their height may require a relatively tall drill floor to allow for clearance of the Christmas tree and blowout preventer.

One style of rig for Arctic drilling is a cantilevered style. In a cantilevered style rig, the drill floor, mast, and well center may be cantilevered out over the well and wellhead to provide suitable vertical clearance for drilling operations. The cantilevered nature of the rig may enable the rig to traverse along a row of wells, completing each well as it moves parallel to the row of wells. However, as the drilling hookload on these cantilevered rigs increases during drilling operations, the drill floor may deflect downward as a result of the cantilevered design. Vertical stiff legs may be added at the back of the rig to support the cantilever. These legs add weight and may make the rig more cumbersome to move along a row of wells, for example.

As a drilling rig moves among multiple wells, such as on a multi-well pad drilling site, each well head may require set up, preparation, and testing prior to drilling operations at that well. Such set up, preparation, and testing may add time to the drilling operations. Additionally, after drilling is completed at a well, time may be spent closing down the well head. These set up and closing times, particularly on a drilling site having multiple wells can add a significant amount of time to the overall drilling operation, increasing the amount of time that the drilling rig has to spend at each well head.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a modular drilling cellar trailer configured to be arranged beneath a drill floor of a drilling rig. The trailer may include a housing for storing well head equipment, a frame coupled to and supporting the housing, and a shear wall configured to extend between the trailer and a ground or pad surface and configured to provide stiffening support to the drill floor of the drilling rig. In some embodiments, the housing may have a plurality of substructure enclosures. The well head equipment may include at least one blowout preventer. The frame may have a pair of bearing feet. In some embodiments, the bearing feet may be inner bearing feet, and the frame may additionally have a pair of outer bearing feet. The inner bearing feet may be configured to engage a rail. In some embodiments, the frame may have at least two tires. Moreover, the shear wall may include a pair of bearing pads.

The present disclosure, in one or more embodiments, additionally relates to a drilling rig having a drill floor and a modular, detachable cellar arranged beneath the drill floor. The modular cellar may have a housing for storing well head equipment, a frame coupled to and supporting the housing, and a shear wall configured to extend between the trailer and a ground or pad surface and configured to provide stiffening support to the drill floor. The housing may have a plurality of substructure enclosures. The well head equipment may include at least one blowout preventer. The frame may have a pair of bearing feet. In some embodiments, the bearing feet may be inner bearing feet, and the frame may additionally have a pair of outer bearing feet. The inner bearing feet may be configured to engage a rail. In some embodiments, the frame may have at least two tires. The shear wall may have a pair of bearing pads in some embodiments.

The present disclosure, in one or more embodiments, additionally relates to a method of drilling. The method may include the steps of towing a cellar trailer to a drilling site. The cellar trailer may have a housing for storing well head equipment, a frame coupled to and supporting the housing, and a shear wall configured to extend between the trailer and a ground surface and configured to provide stiffening support to the drill floor. The method may additionally include positioning the cellar trailer over a well head, positioning the drill rig such that a drill floor is arranged over the cellar trailer, coupling the drill floor to the cellar trailer, and stiffening the drill floor by arranging a shear wall between the trailer and a ground or pad surface. In some embodiments, the drill rig is a cantilever-style drill rig. The cellar trailer may include an inner pair of bearing feet and an outer pair of bearing feet. In some embodiments, the well head may be one of a row of well heads, and the cellar trailer may be configured to skid parallel to the row of well heads to a next well head.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to a drilling rig having a detachable, modular cellar arranged beneath a drill floor of the drilling rig. The cellar may be or include a cellar trailer and may be configured to house drilling equipment, such as well head equipment. For example, the cellar trailer may house one or more blowout preventers and/or other well head equipment. In some embodiments, the cellar trailer may provide work areas, such that the well head equipment may be prepared, tested, or generally operated within the cellar trailer. The cellar trailer may additionally be configured to provide structural support to the drilling rig. For example, the cellar trailer may provide stiffening support to the drill floor in order to mitigate deflection of the drill floor during drilling operations. The stiffening support may be provided by a shear wall extending from the cellar trailer. The cellar trailer may be towable, such as by a towing vehicle. The cellar trailer may additionally be skiddable and/or walkable in some embodiments. A cellar trailer of the present disclosure may generally allow work to begin on a well without the drilling rig present, and may additionally allow work to be completed on a well without the drilling rig present, which may decrease overall drilling operation time. Additionally, a cellar trailer of the present disclosure may significantly reduce equipment load on the drilling rig.

Figure 1:
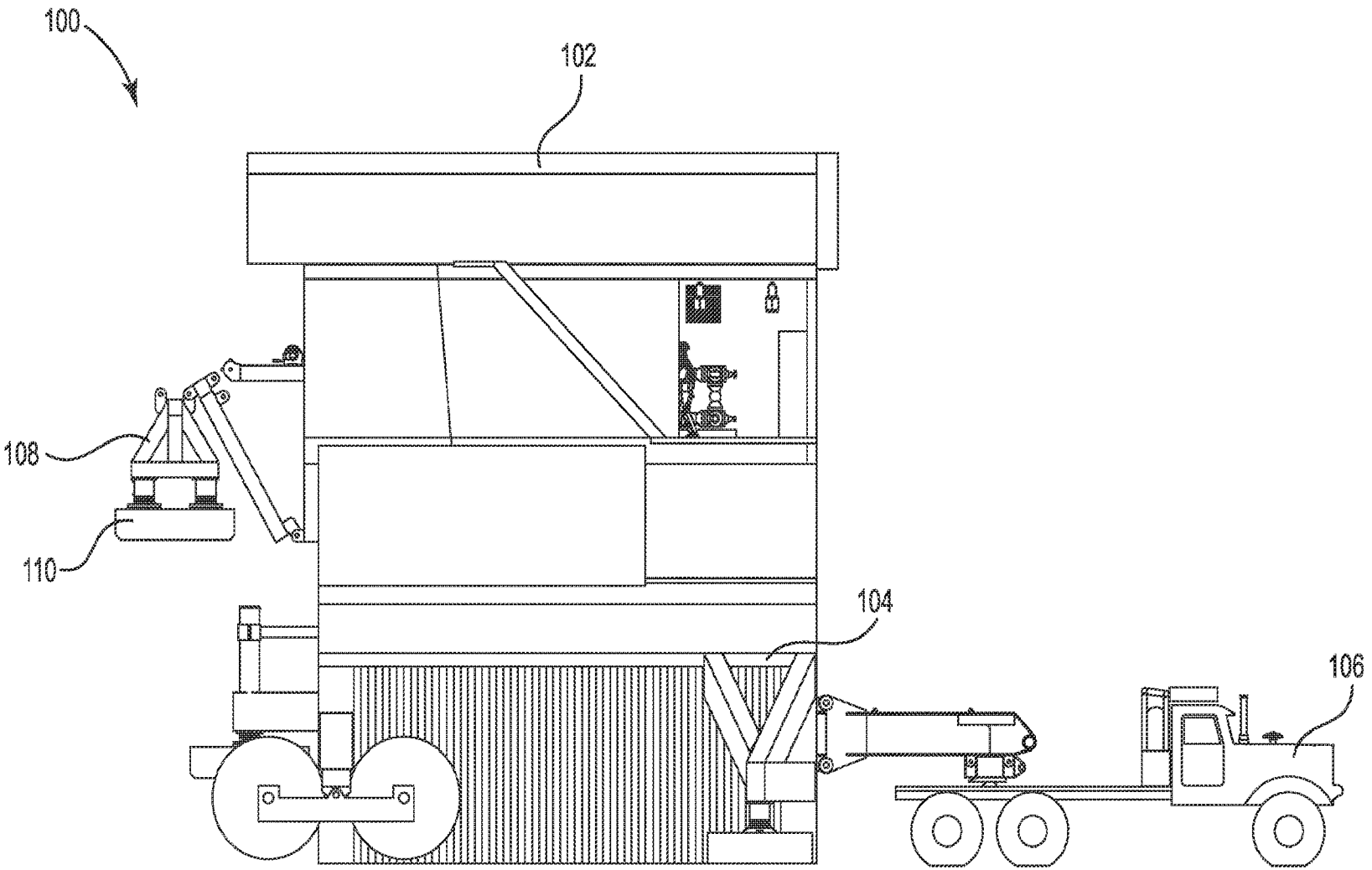
FIG. 1 is a side view of a cellar trailer of the present disclosure, according to one or more embodiments.
Figure 2:
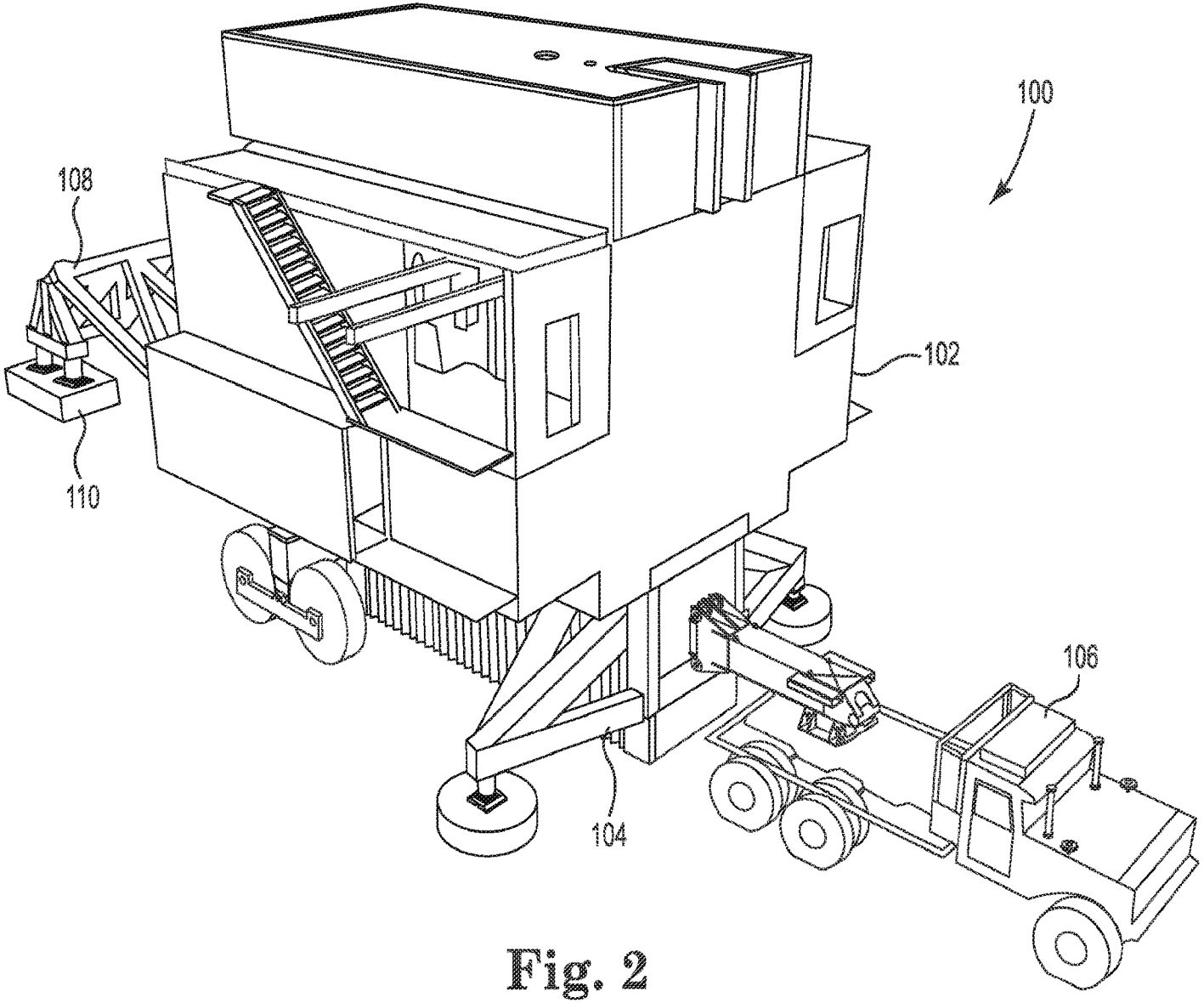
FIG. 2 is a perspective view of a cellar trailer of the present disclosure, according to one or more embodiments.
Figure 3:
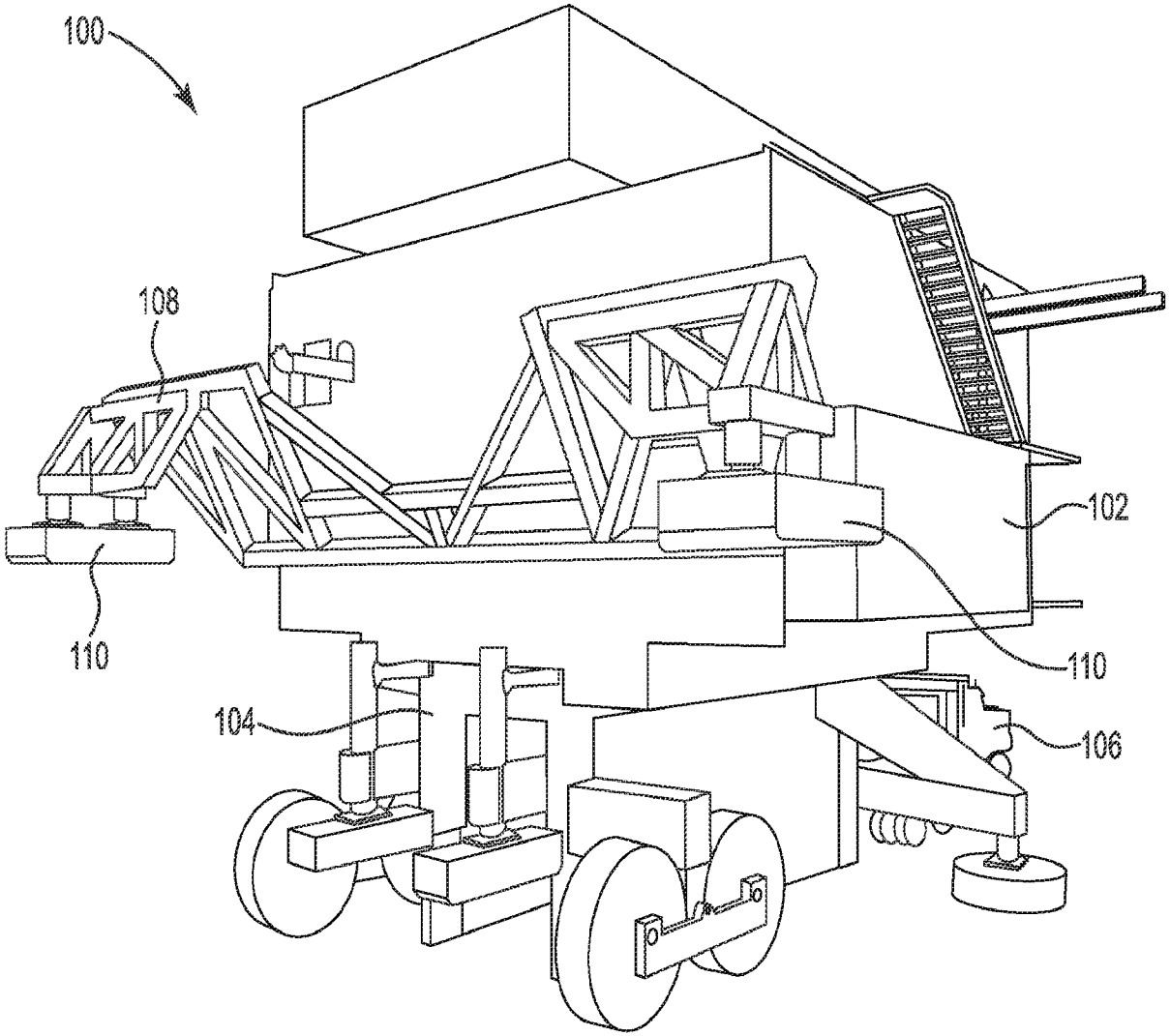
FIG. 3 is another perspective view of a cellar trailer of the present disclosure, according to one or more embodiments.
Figure 4:
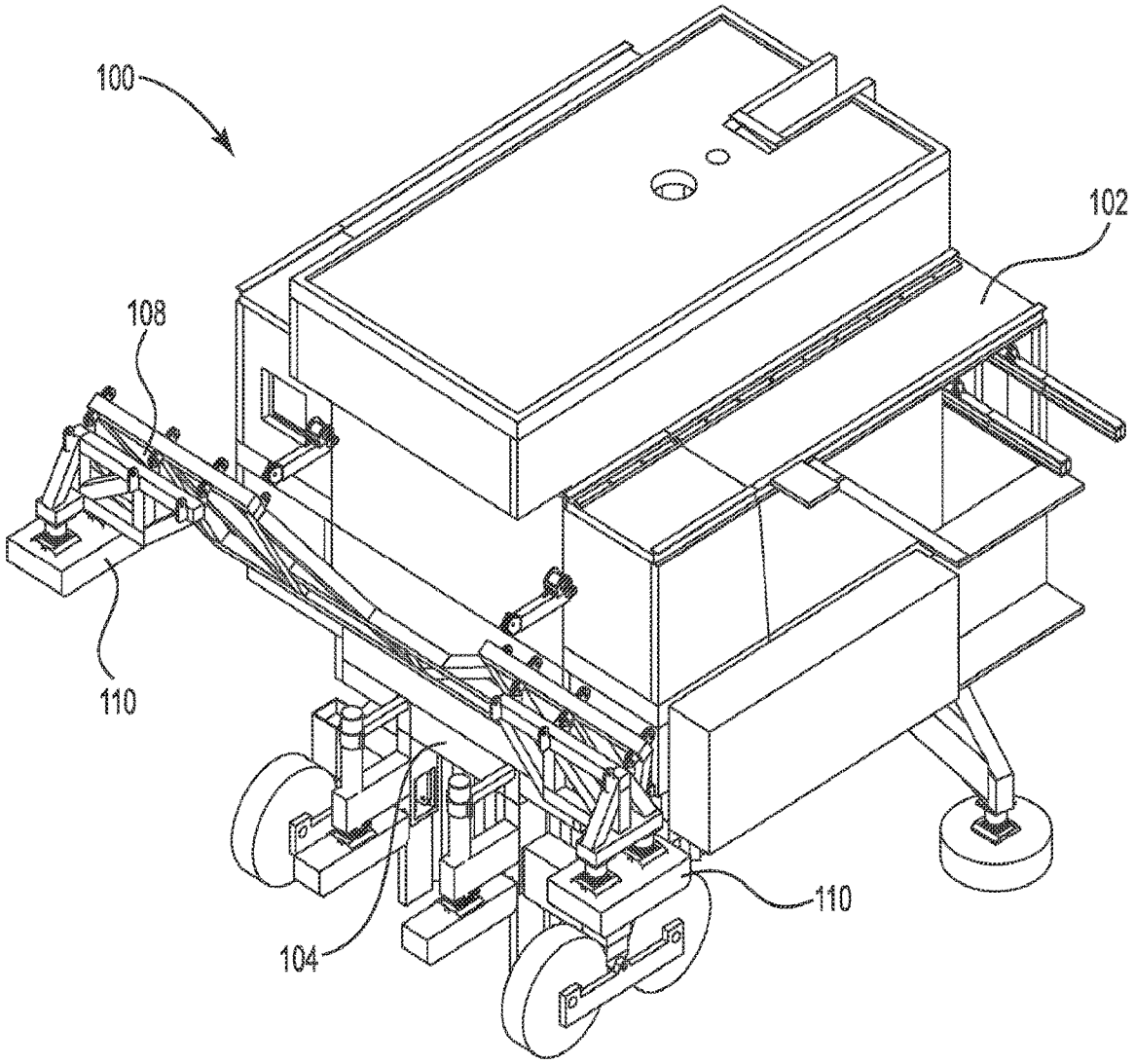
FIG. 4 is another perspective view of a cellar trailer of the present disclosure, according to one or more embodiments.

Turning now to FIG. 1, a cellar trailer 100 of the present disclosure is shown. FIGS. 2-4 show perspective views of the cellar trailer 100. The cellar trailer 100 may be configured to house one or more blowout preventers, such as a primary or main blowout preventer and a diverter blowout preventer for a drilling operation. The cellar trailer 100 may additionally or alternatively hold other drilling equipment in some embodiments. The cellar trailer 100 may be configured to be arranged beneath a drill floor of a drilling rig or drilling module, and over a well head, such that the blowout preventer(s) and/or other drilling equipment may be operated during a drilling operation. In this way, the cellar trailer 100 may be configured to maintain the blowout preventer(s) and/or other drilling equipment modularly and separate from the drill rig or drilling module itself. The cellar trailer 100 may generally be configured to couple to a drilling rig or drilling module. In some embodiments, the cellar trailer 100 may be configured to support or stiffen the drill floor of the drilling rig or module, by passing loading from the drill floor through the cellar trailer to the ground or pad surface. In some embodiments, the cellar trailer 100 may be towable by a truck, tractor, or other towing vehicle, such that the trailer may be moved between drilling locations, such as between drilling pads and/or among wells on a multi-well drilling pad. The cellar trailer 100 may generally have a housing 102 arranged on a frame 104. The frame 104 may be coupled to a towing vehicle 106. The trailer 100 may additionally have a shear wall 108 with one or more bearing pads 110.

Figure 5:
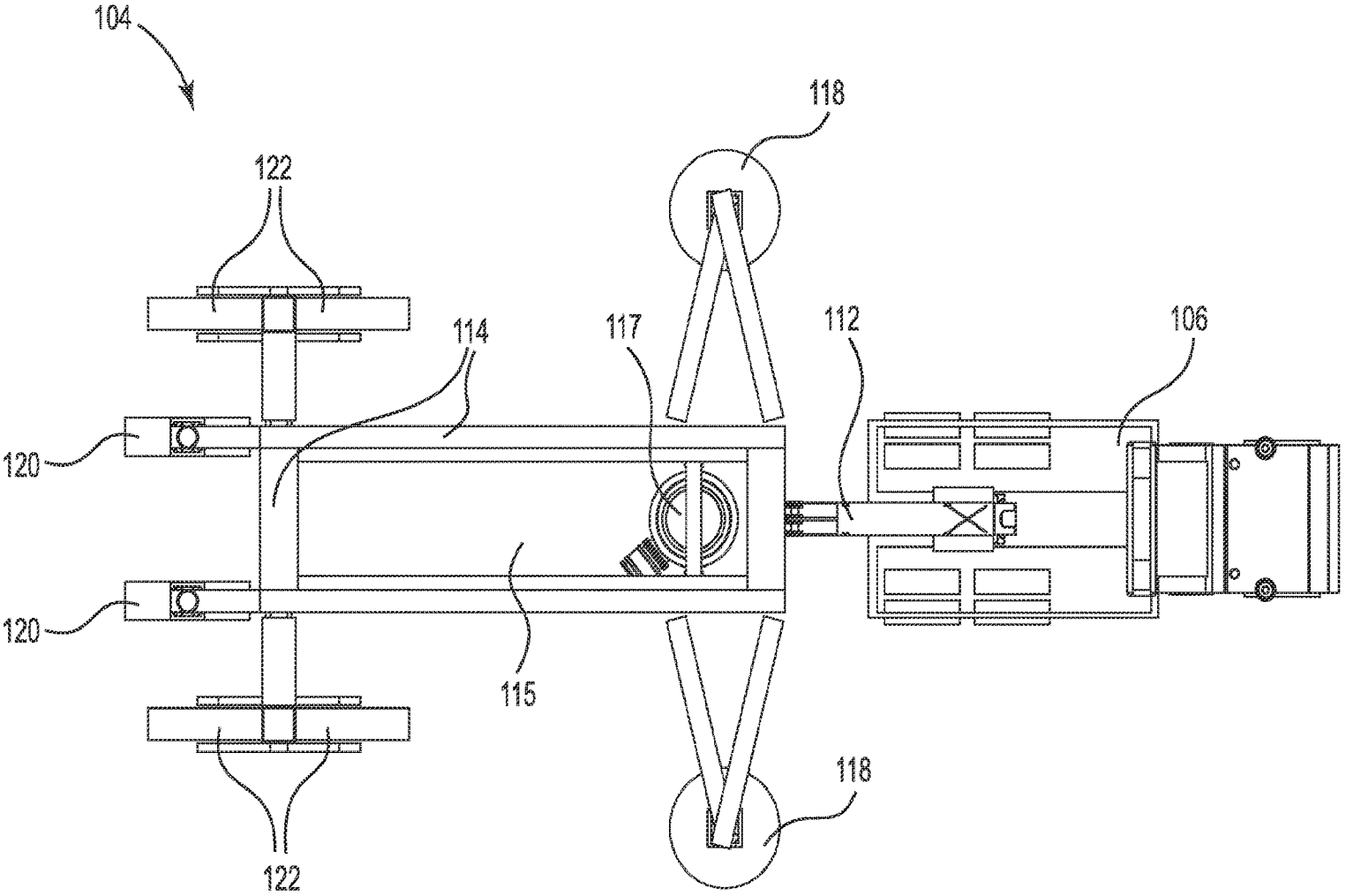
FIG. 5 is an overhead view of a frame of a cellar trailer of the present disclosure, according to one or more embodiments.
Figure 6:
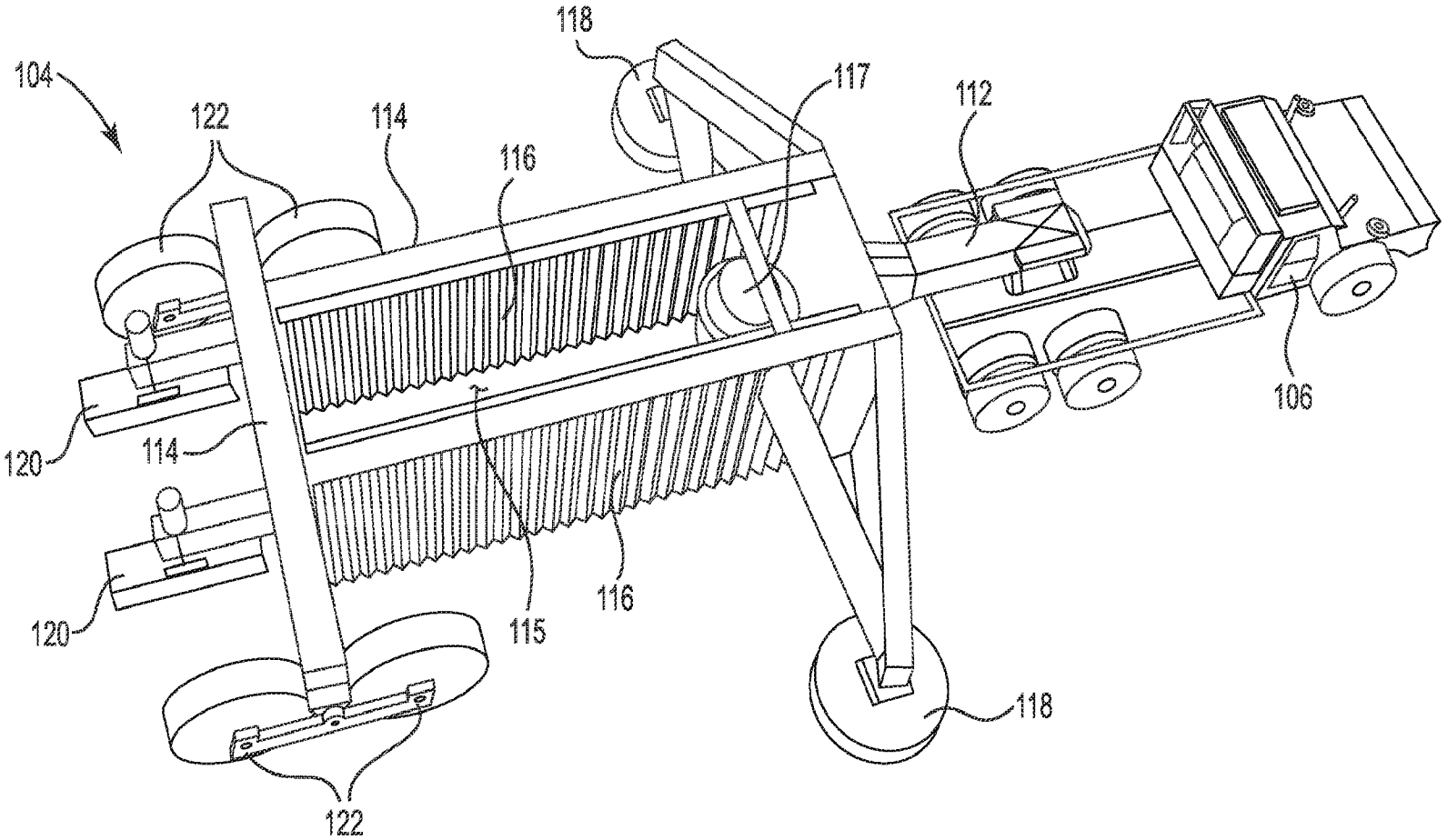
FIG. 6 is a perspective view of a frame of a cellar trailer of the present disclosure, according to one or more embodiments.

FIGS. 5 and 6 show overhead and perspective views of the frame 104, respectively. The frame 104 may be configured to support the housing 102, as well as the blowout preventer(s) and/or any other drilling equipment within the housing. The frame 104 may additionally be configured to transfer loading from the trailer 100 and on the trailer from the drill floor to the ground via one or more tires, bearing feet, skidding feet, and/or walking feet. In some embodiments, the frame 104 may have a trailer hitch 112 arranged on a tow end. The hitch 112 may include a ball hitch, pintle hook, fifth wheel hitch, or other towing device such that the trailer may be towed by a towing vehicle. The frame 104 may generally be constructed of steel or other suitable materials. In some embodiments, the frame may have a plurality of support beams 114, a pair of sidewalls 116, a pair of outer bearing feet 118, a pair of inner bearing feet 120, and one or more pairs of tires 122.

The plurality of support beams 114 may generally be configured to support the housing 102 and drilling equipment, such as one or more blowout preventers. The support beams 114 may additionally be configured to provide ground clearance beneath the housing 102, such that the trailer 100 may be towed or skidded over a well head. In some embodiments, the support beams 114 may provide a ground clearance of between approximately 5 and approximately 25 feet. Particularly, the ground clearance may be between 10 and 15 feet in some embodiments. In other embodiments, the plurality of support beams 114 may provide more or less ground clearance. In some embodiments, an area between the support beams 114 and ground surface, and thus arranged beneath the housing, may be a lower cellar area 115.

In some embodiments, one or more sidewalls 116 may extend from the support beams 114 in order to provide a housing or partial housing for the lower cellar area 115. For example, in some embodiments, a sidewall 116 may extend around each of at least two sides of the lower cellar area 115. In some embodiments, one or more sidewalls 116 may be retractable and/or readily removable so as to allow the trailer 100 to move over or across equipment and/or well heads. The lower cellar area 115 may provide a housing for the well head. In some embodiments, the lower cellar area 115 may additionally store equipment, such as a diverter blowout preventer 117 and/or other drilling equipment. In some embodiments, the lower cellar area 115 may have hoisting and/or handling equipment for moving the diverter blowout preventer 117 and/or other equipment. Such hoisting and/or handling equipment may be coupled to the frame 104 in some embodiments.

An outer bearing foot 118 may be coupled to each of two sides of the frame 104 at the tow end in some embodiments. For example, beams 114 may extend laterally from the frame 104 on each of a driller side and an off-driller side to provide an outer bearing foot 118. The outer bearing feet 118 may help to stabilize the trailer 100. In some embodiments, the outer bearing feet 118 may be configured to be arranged in one or more positions, such as a roading position and a drilling position. For example, each bearing foot 118 may couple to the frame 104 with a hydraulic cylinder. In a roading position, the hydraulic cylinders may be retracted such that the bearing feet 118 may be above ground level, and such that the trailer 100 may be supported by the tires 122. In a drilling position, the hydraulic cylinders may extend, such that the bearing feet 118 may be arranged on a ground or pad surface to help support, stabilize, and/or level the trailer 100. In some embodiments, the outer bearing feet 118 may have a walking or skidding mechanism, such that the outer bearing feet may be used to move the trailer 100 in one or more directions. In some embodiments, the outer bearing feet 118 may allow for bi-directional movement of the trailer 100.

Similarly, the trailer 100 may additionally or alternatively have a pair of inner bearing feet 120 coupled to the frame 104, such as coupled to a rear portion of the frame opposite the tow end and extending rearwardly from the trailer. The inner bearing feet 120 may help to stabilize the trailer 100. In some embodiments, the inner bearing feet 120 may be configured to be arranged in one or more positions, such as a roading position and a drilling position. For example, each bearing foot 120 may couple to the frame 104 with a hydraulic cylinder. In a roading position, the hydraulic cylinders may be retracted such that the bearing feet 120 may be above ground level, and such that the trailer 100 may be supported by the tires 122. In a drilling position, the hydraulic cylinders may extend, such that the bearing feet 120 may be arranged on a ground or pad surface to help support, stabilize, and/or level the trailer 100. In some embodiments, the inner bearing feet 120 may additionally be configured for arranging in a skidding position. For example, the inner bearing feet 120 may be configured to be arranged on a rail or set of rails along a ground or pad surface. The rails may allow the inner bearing feet 120 to help support the trailer 100 as the trailer is skidded or otherwise moved between well heads along a row of wells, for example. In some embodiments, the skidding position may include retracting or extending the hydraulic cylinders to bring the inner bearing feet 120 to a height corresponding with the rail(s). The skidding position may additionally include rotating the inner bearing feet 120 in some embodiments. For example, the inner bearing feet 120 may be rotated approximately 90 degrees in order to engage the rail(s). Additionally or alternatively, in some embodiments, the inner bearing feet 120 may have a walking or skidding mechanism. In some embodiments, the inner bearing feet 120 may allow for bi-directional movement of the trailer. The inner 120 and outer 118 hearing feet may operate in conjunction with one another to facilitate skidding or walking movement of the trailer 100 in some embodiments.

The trailer 100 may additionally have one or more tires 122 or pairs of tires, which may be coupled to the frame 104. For example, one pair of tires 122 may extend from the frame 104 on each of a driller side and an off-driller side of the trailer 100. The tires 122 may generally be sized to support the equipment loading on the trailer 100 and, in some embodiments, applied loading from drilling operations. The tires 122 may generally be configured to be arranged in multiple positions. For example, in a roading position, the tires may be arranged on the frame 104 and in contact with a ground or pad surface. Additionally, in the roading position, the tires 122 may be arranged in an orientation paralleling that of the tires of a towing vehicle 106, such that the tires 122 may operate to move the trailer 100 in the direction of towing. In some embodiments, the tires 122 may be removed during drilling and/or other operations. In some embodiments, the tires 122 may additionally be configured for arranging in a skidding position. In a skidding position, the tires may be rotated approximately 90 degrees to an orientation such that the tires may operate to move the trailer 100 in a direction perpendicular to that of the towing direction.

Figure 7:
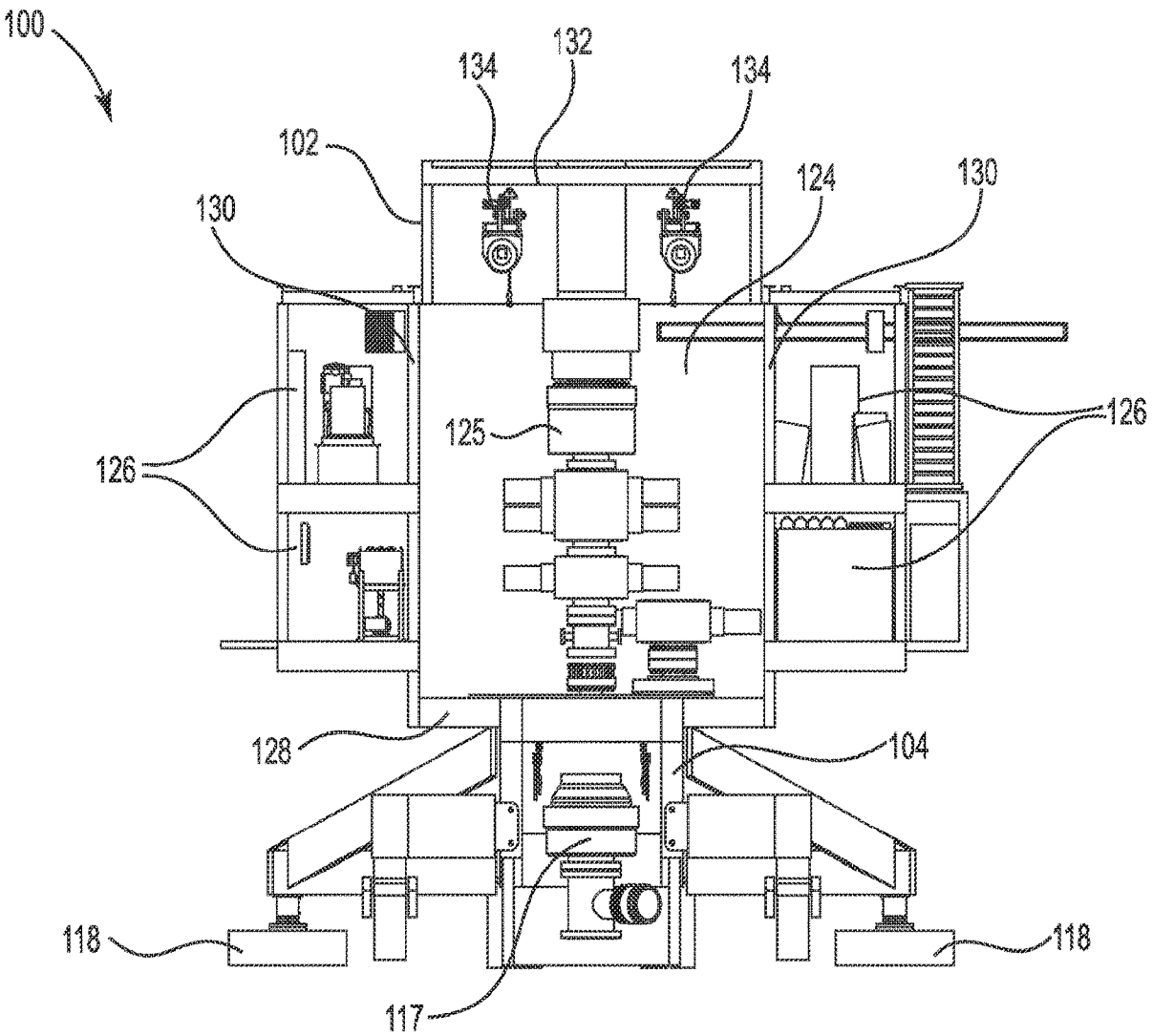
FIG. 7 is an internal end view of a cellar trailer of the present disclosure, according to one or more embodiments.
Figure 8:
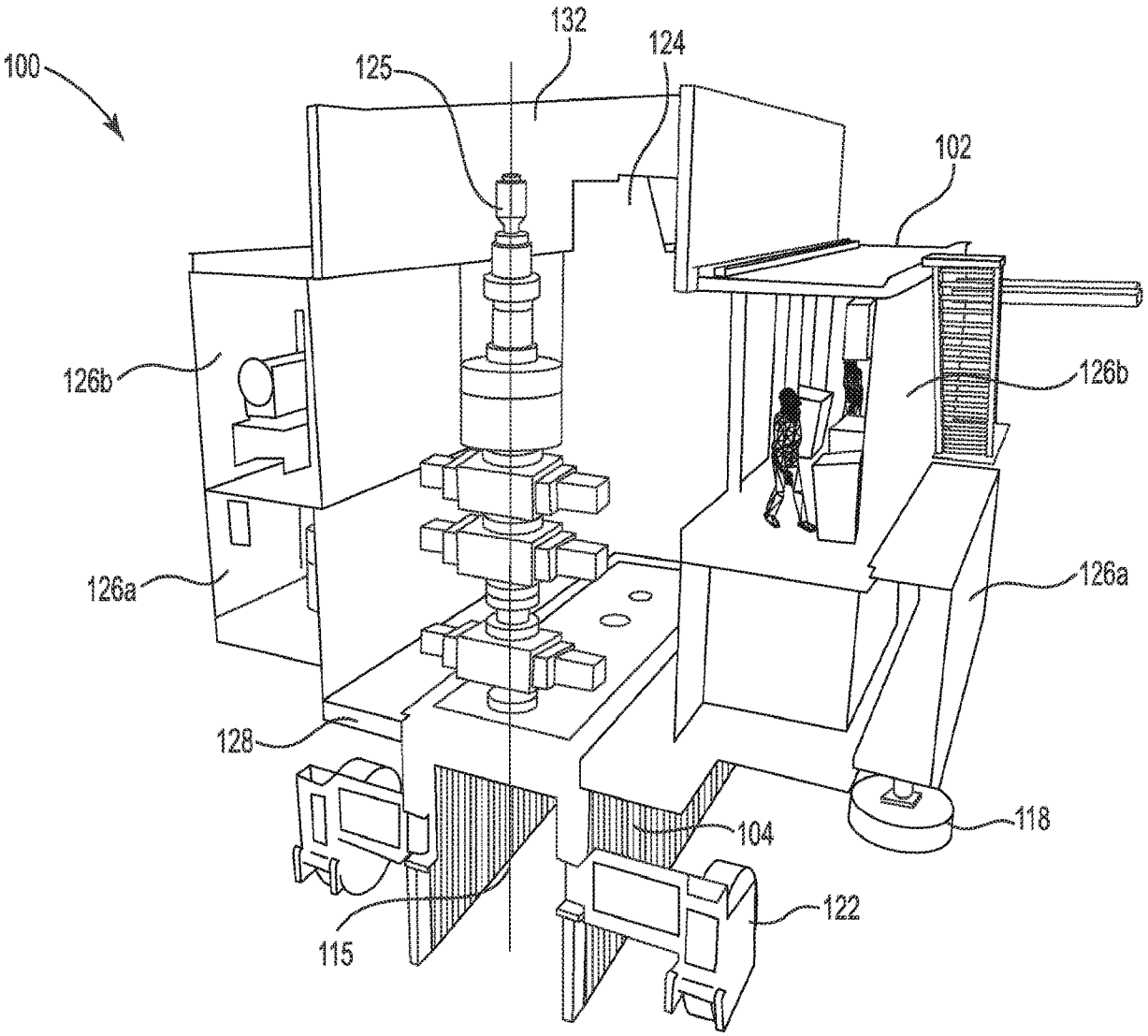
FIG. 8 is a perspective internal view of a cellar trailer of the present disclosure, according to one or more embodiments.

The housing 102 may be arranged on, and may be generally supported by, the frame 104. The housing 102 may be configured to house one or more blowout preventers, such as a main blowout preventer 125 and/or other drilling equipment. The housing 102 may additionally provide a work area for workers during drilling operations. The housing 102 may be configured to provide an enclosed or partially enclosed environment around the well head to contain gasses. The housing 102 may additionally be configured to provide one or more enclosed work environments for workers, thus providing protection from the environment. In some embodiments, the housing 102 or a portion thereof may be climate controlled. For example, with respect to Arctic drilling operations, the housing 102 or a portion thereof may be heated. As shown in FIGS. 7 and 8, the housing 102 may generally be divided into a mezzanine 124 and one or more subassemblies 126 arranged around the mezzanine.

Figure 9:
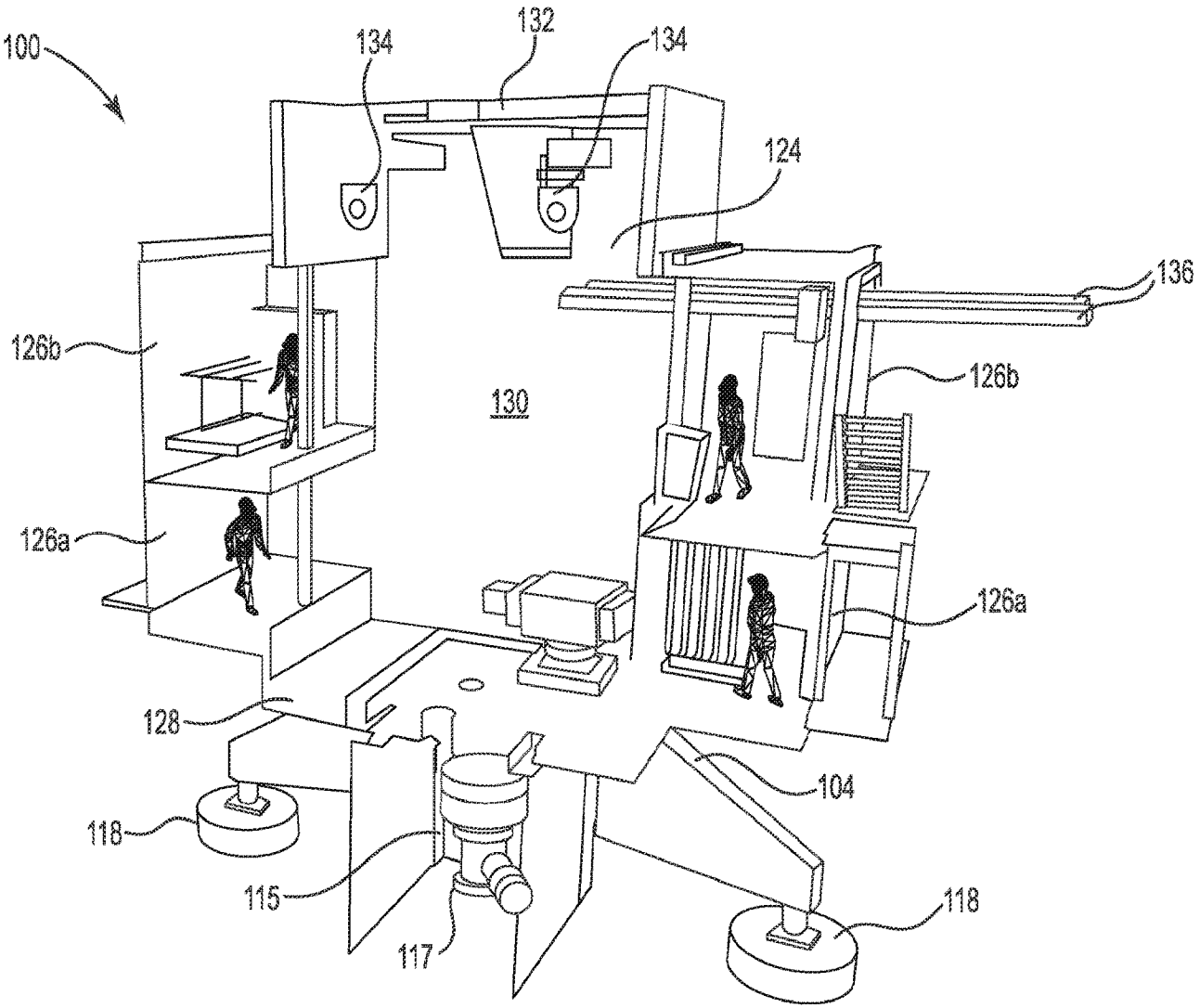
FIG. 9 is a perspective internal view of a cellar trailer of the present disclosure, according to one or more embodiments.
Figure 10:
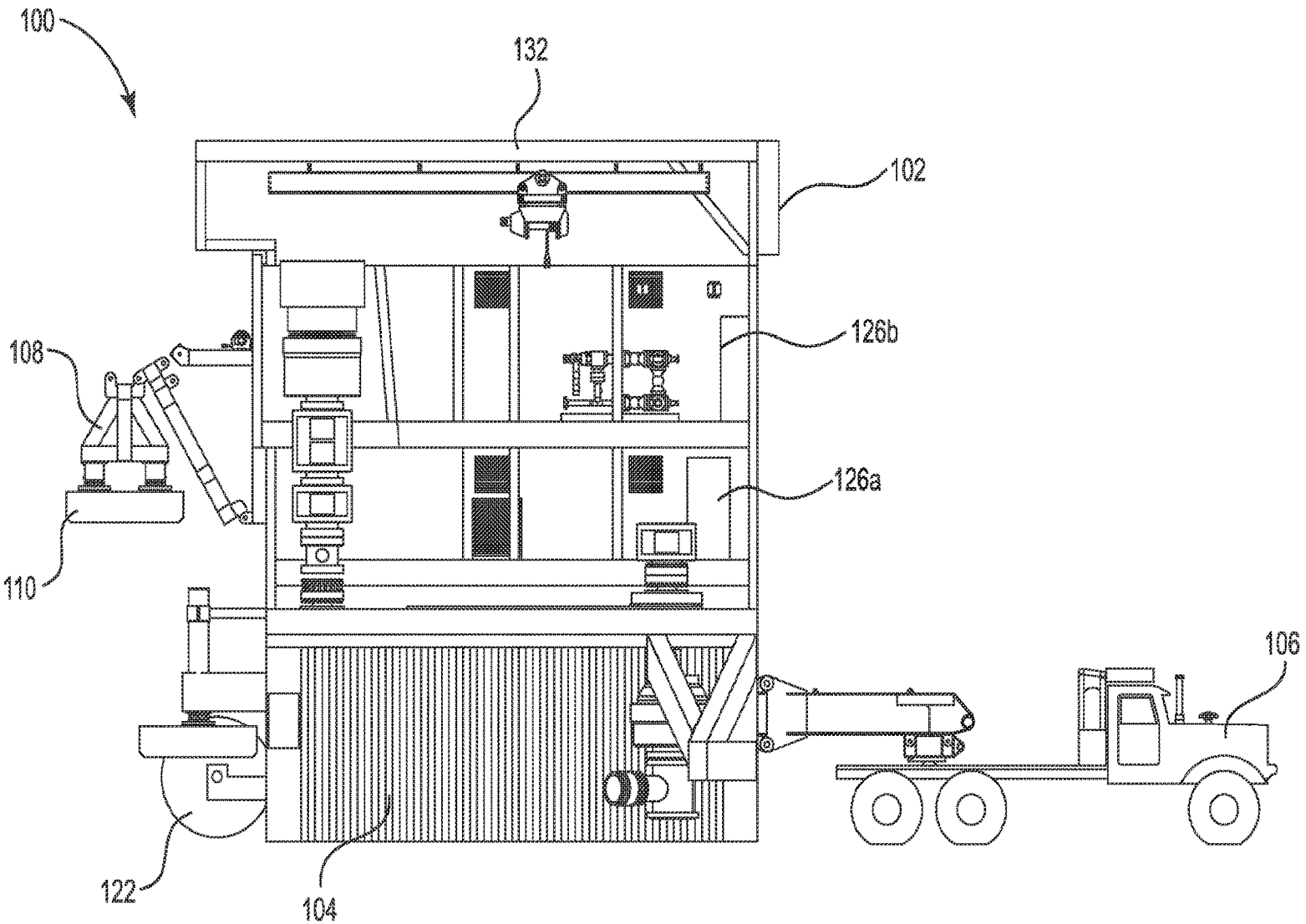
FIG. 10 is a side internal view of a cellar trailer of the present disclosure, according to one or more embodiments.
Figure 11:
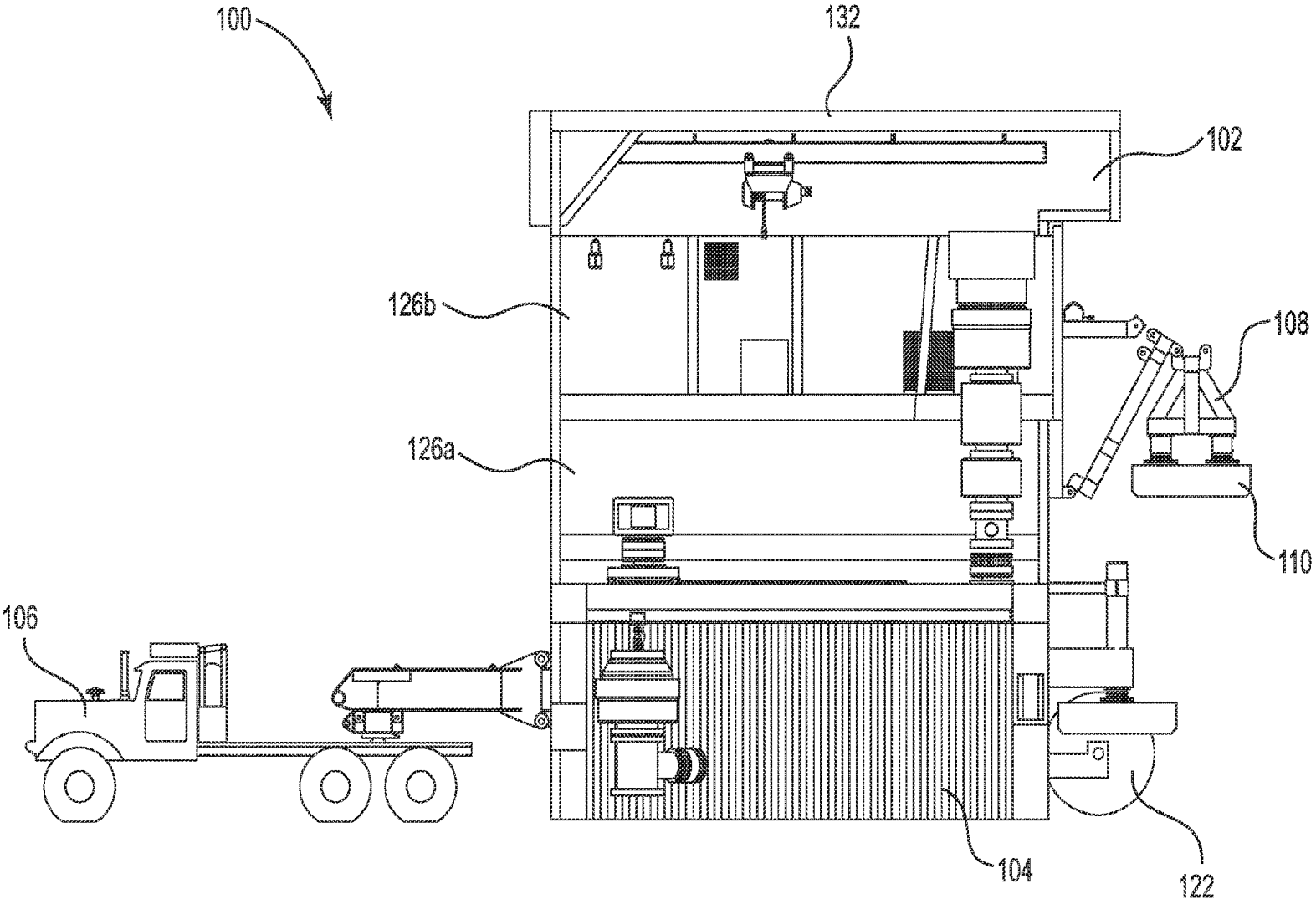
FIG. 11 is another side internal view of a cellar trailer of the present disclosure, according to one or more embodiments.
Figure 12:
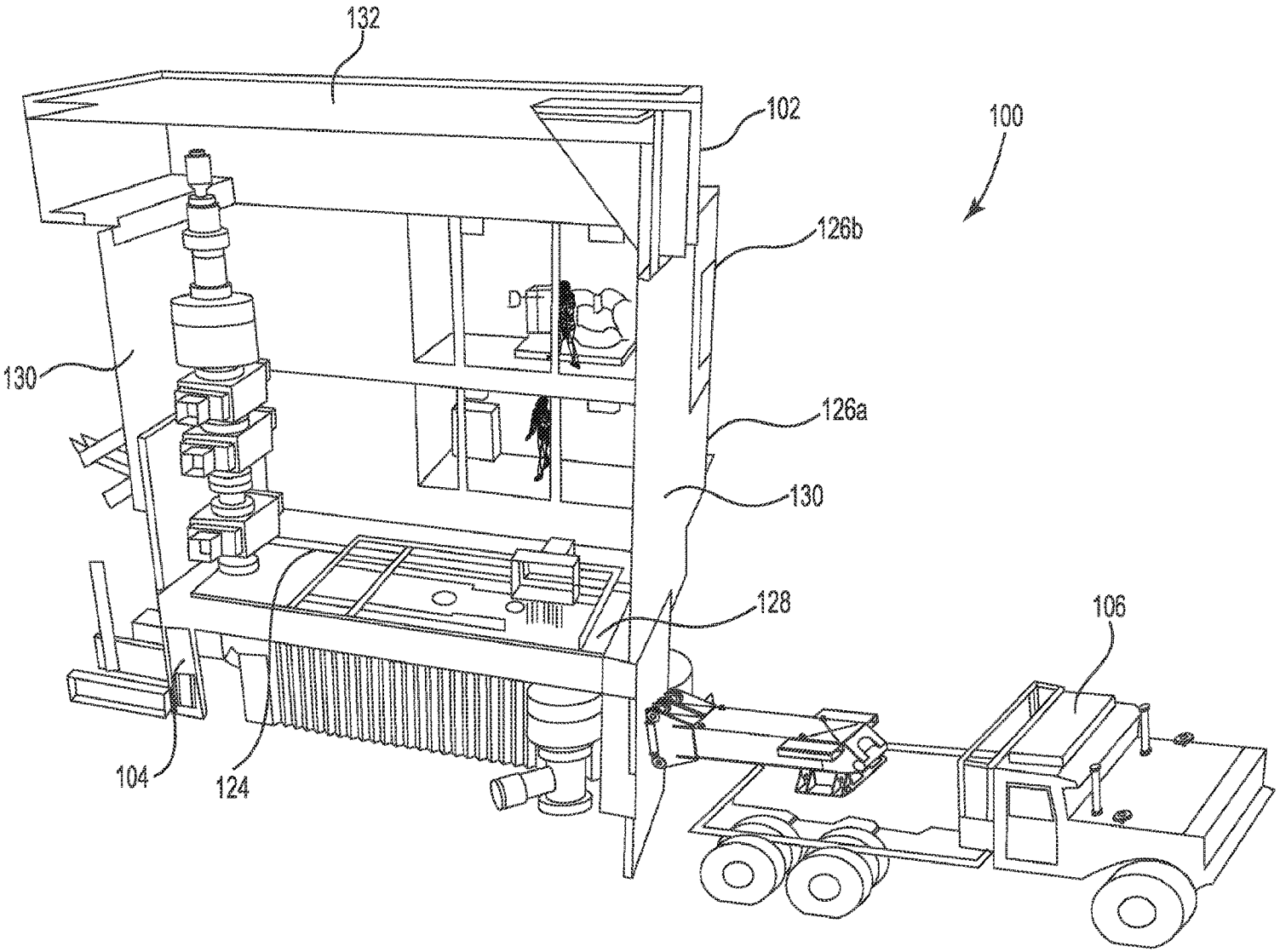
FIG. 12 is a perspective internal view of a cellar trailer of the present disclosure, according to one or more embodiments.
Figure 13:
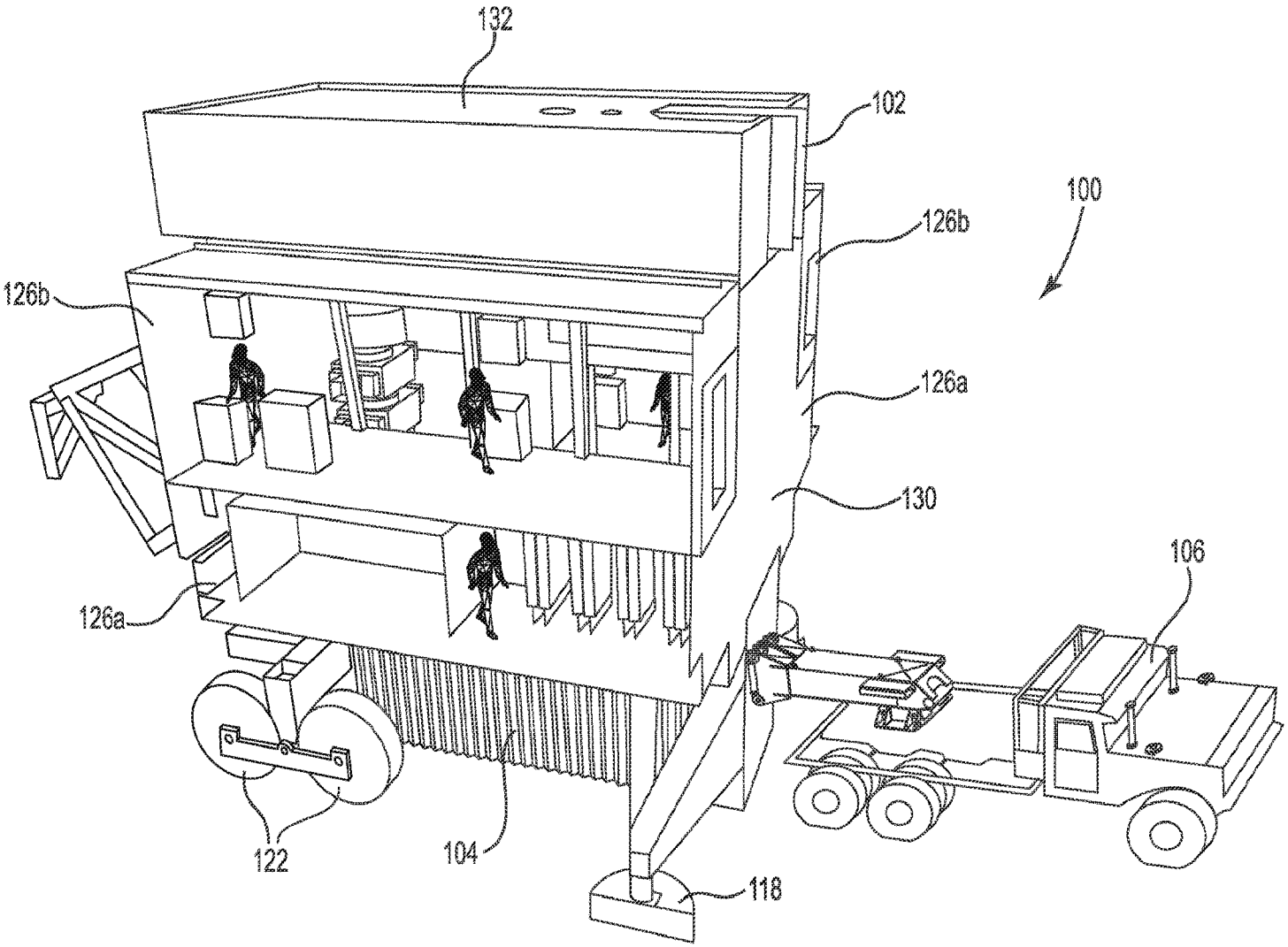
FIG. 13 is a perspective internal view of a cellar trailer of the present disclosure, according to one or more embodiments.
Figure 14:
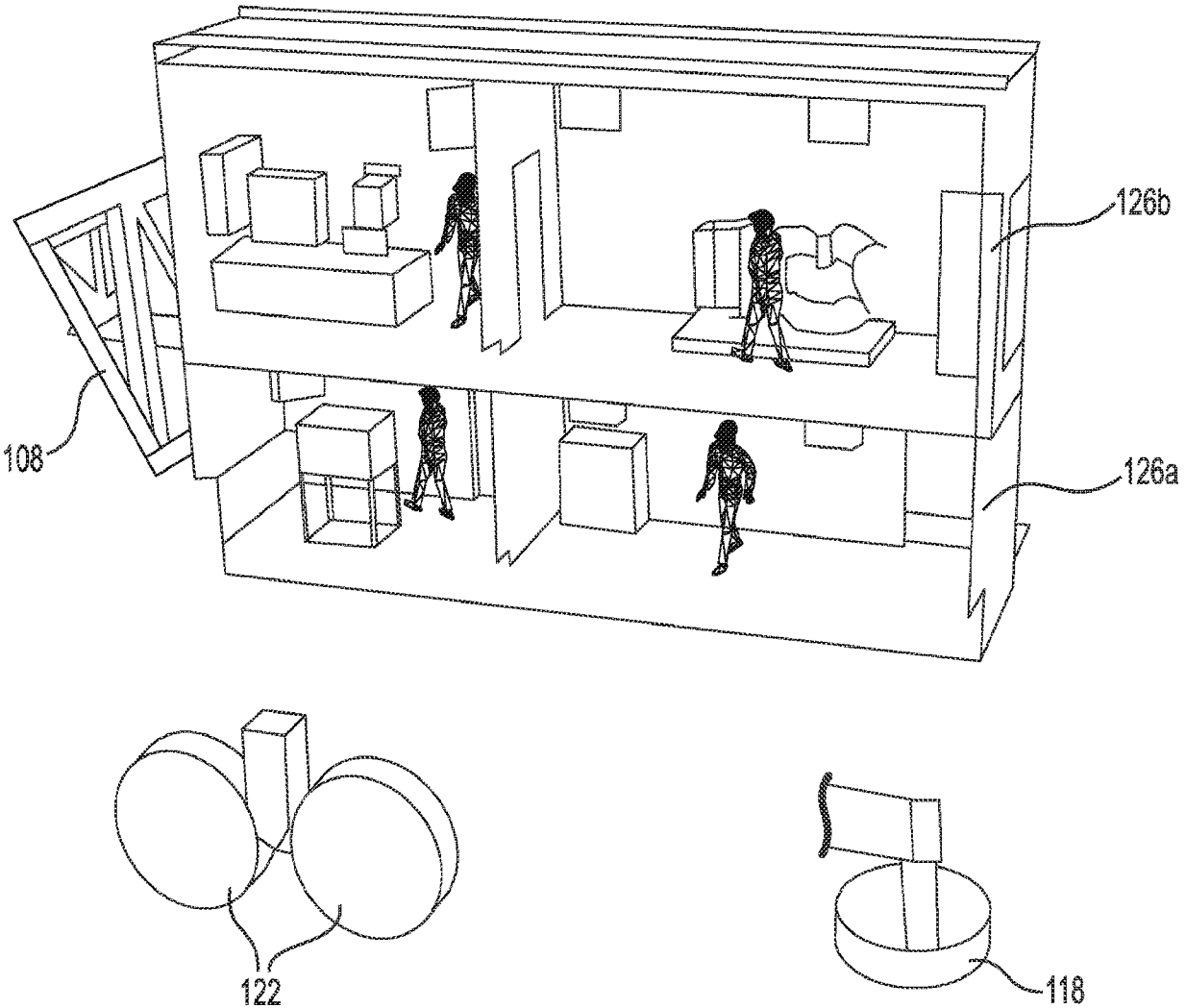
FIG. 14 is an isolated internal view of substructure enclosures of the present disclosure, according to one or more embodiments.

The mezzanine 124 may be configured to house equipment, such as but not limited to, a main blowout preventer 125. The mezzanine 124 may generally have a floor portion 128 arranged on or above the frame 104. The floor portion 128 may be configured to be arranged over the lower cellar area 115 and/or over a well head. In some embodiments, an opening may be arranged in the floor portion 128 to accommodate a well pipe. The mezzanine 124 may additionally have wall portions 130, such as four wall portions, coupled to the floor portion 128 and defining the walls of the mezzanine enclosure. The mezzanine 124 may additionally have a ceiling portion 132 arranged over the mezzanine and coupled to the wall portions 130. The wall portions 130 may extend to a height to arrange the ceiling portion 132 at a height configured to accommodate the main blowout preventer 125 or other drilling equipment. However, the wall portions 130 and ceiling portion 132 may have a height additionally configured to be arranged beneath a drill floor of a drilling rig. The ceiling portion 132 may have an opening configured to accommodate a well pipe. In some embodiments, the mezzanine 124 may be configured to be a sealed or partially sealed enclosure. In some embodiments, the mezzanine 124 may have various hoisting and/or handling mechanisms or equipment. For example, as shown in FIGS. 7 and 9, one or more hoisting mechanisms 134 may be arranged along the ceiling portion 132 in order to hoist the main blowout preventer 125 on and off a well head, and/or for hoisting other equipment. Additionally or alternatively, the mezzanine 124 may have a track along the floor portion 128 and configured to engaged one or more carts for transporting equipment around the well head and/or blowout preventer. In still other embodiments, the mezzanine 124 may include other or additional handling and/or hoisting equipment or mechanisms.

Figure 15:
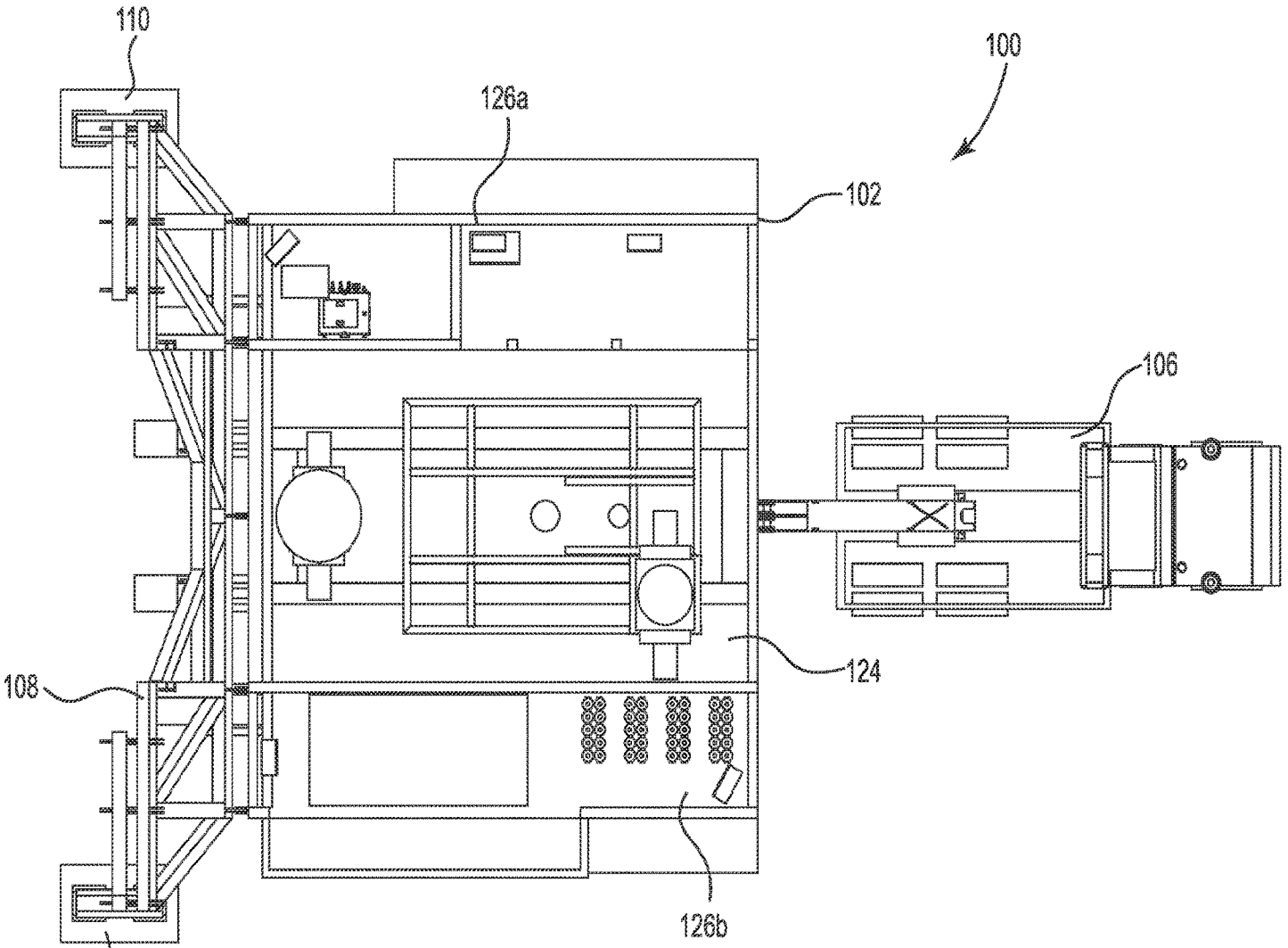
FIG. 15 is an overhead internal view of a cellar trailer of the present disclosure, according to one or more embodiments.
Figure 16:
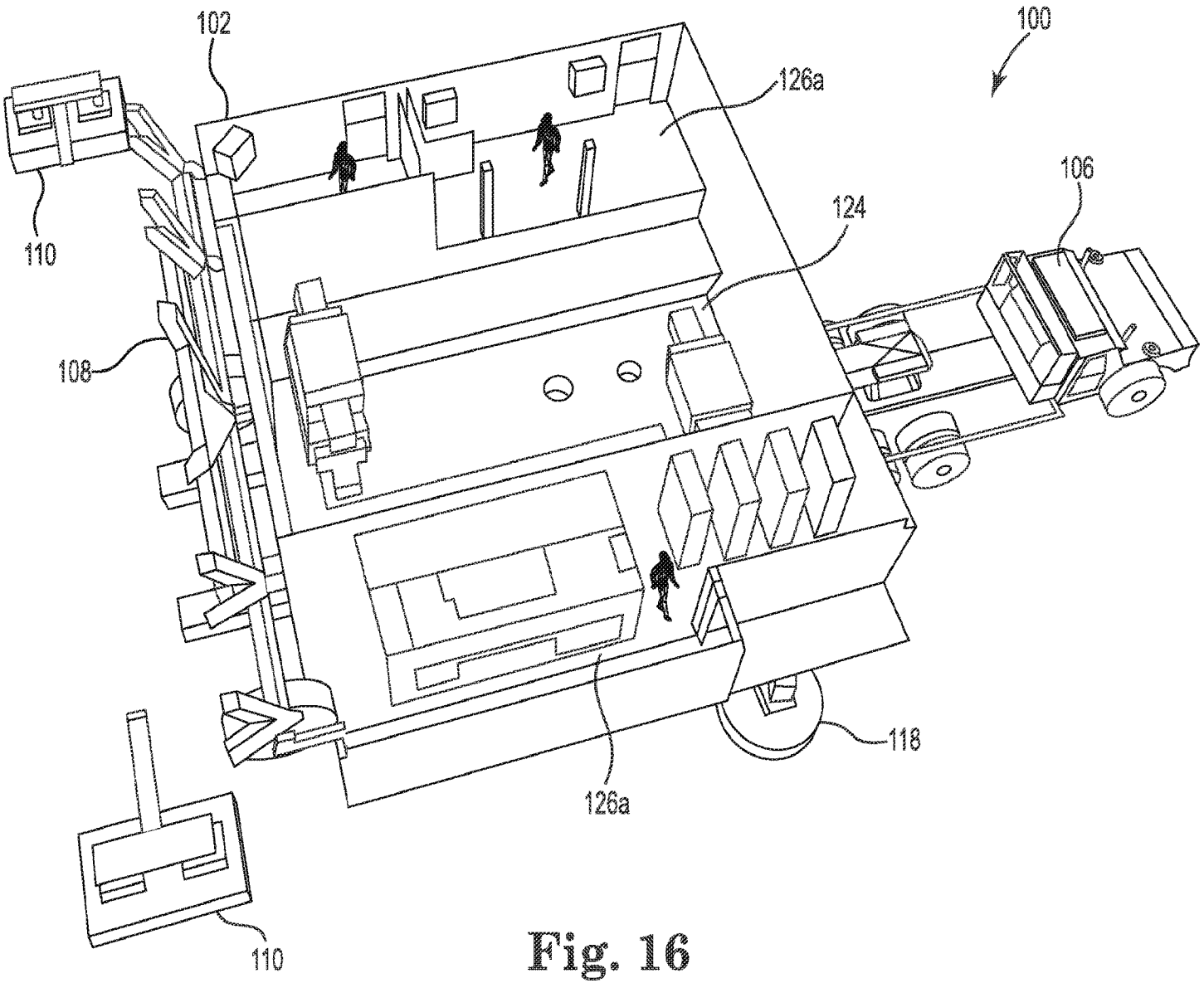
FIG. 16 is a perspective internal view of a cellar trailer of the present disclosure, according to one or more embodiments.
Figure 17:
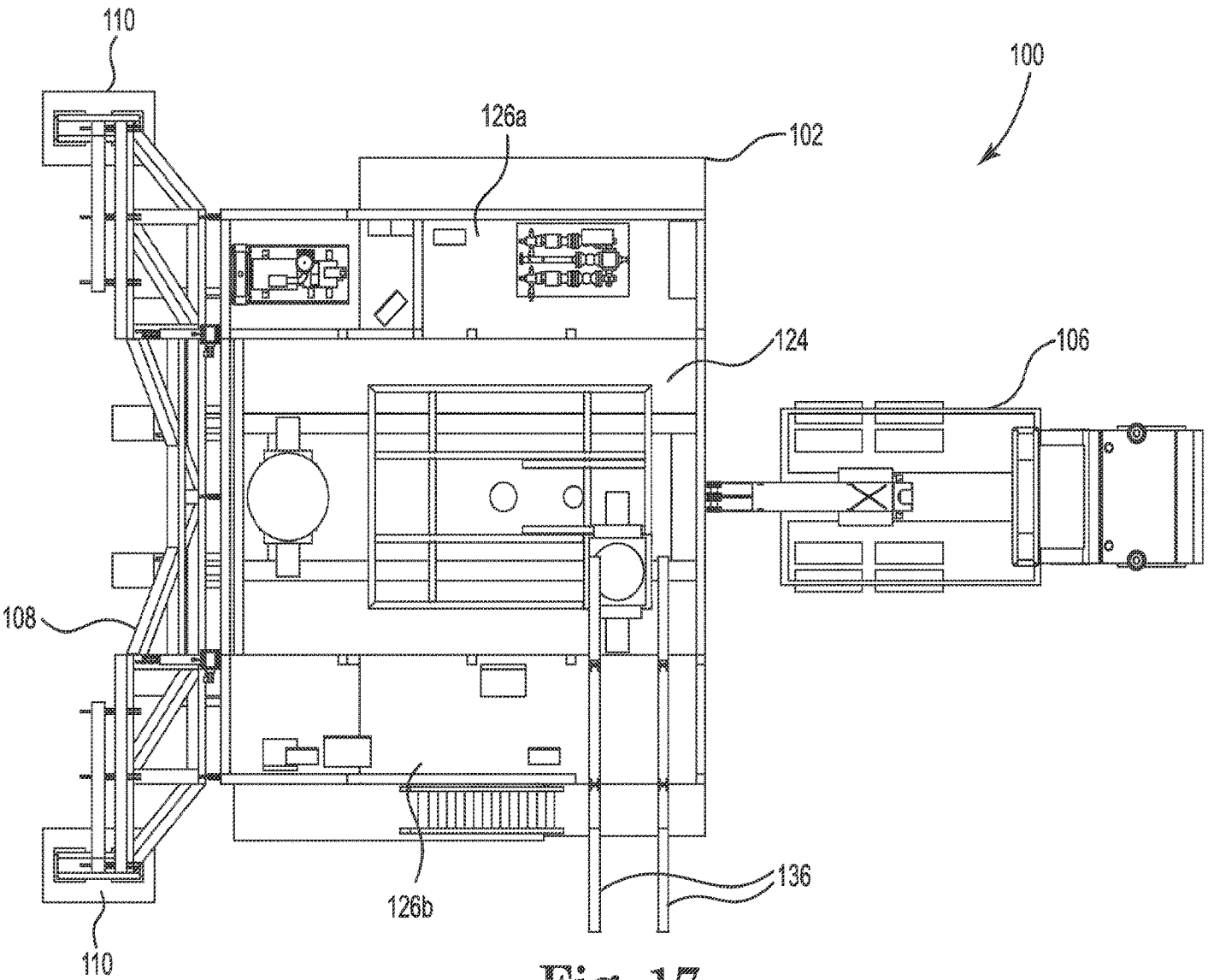
FIG. 17 is another perspective internal view of a cellar trailer of the present disclosure, according to one or more embodiments.
Figure 18:
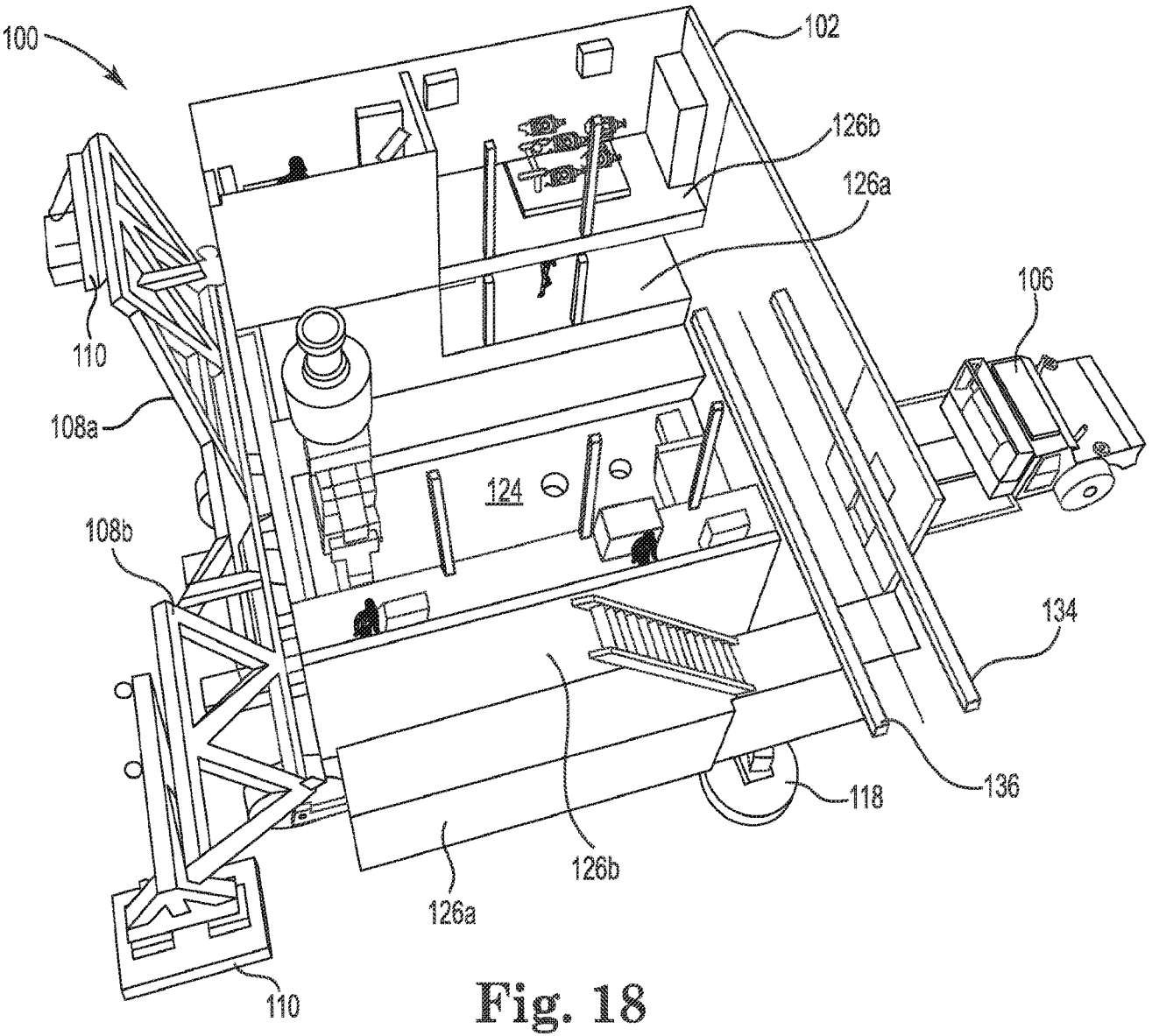
FIG. 18 is another perspective internal view of a cellar trailer of the present disclosure, according to one or more embodiments.
Figure 19:
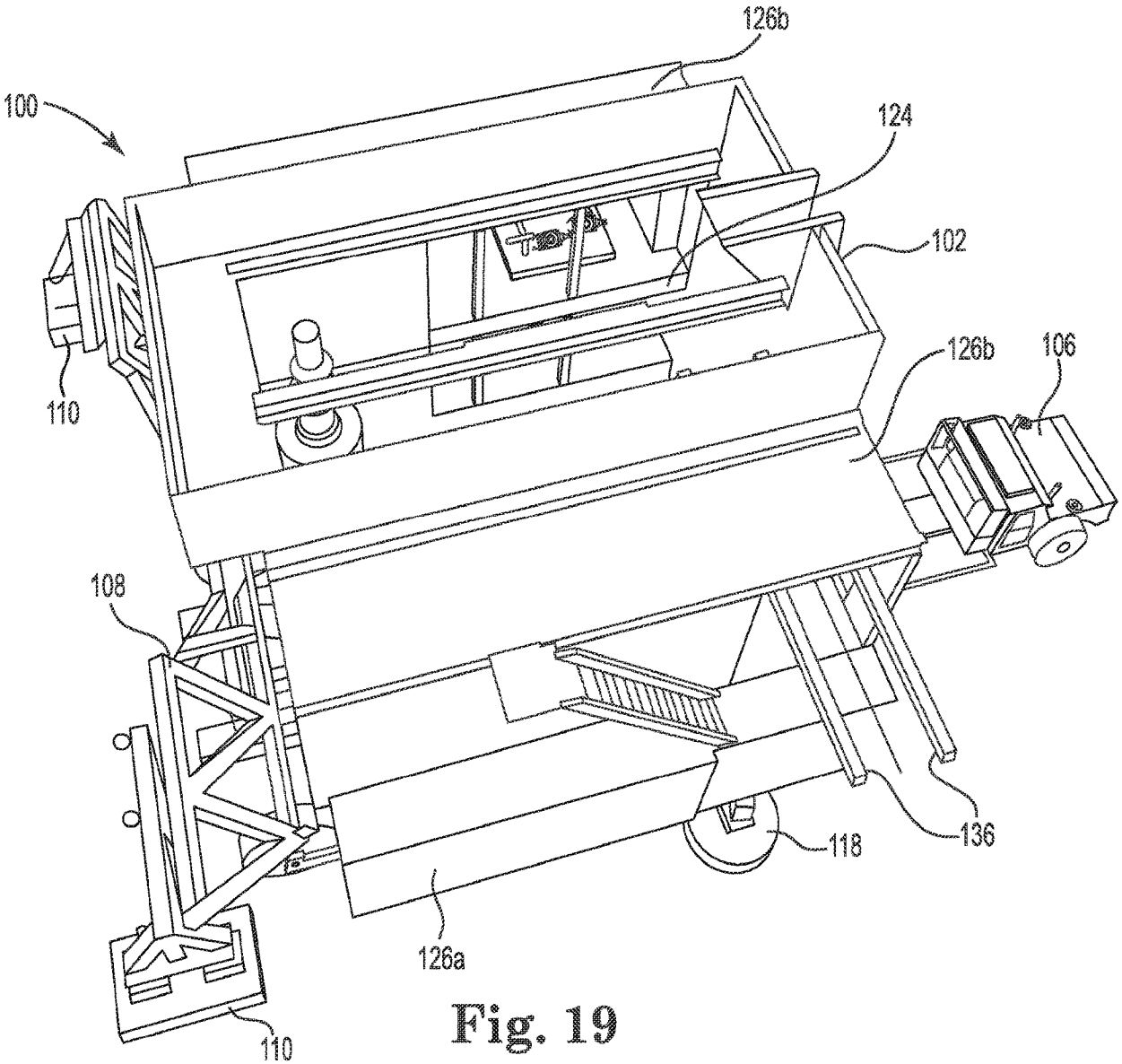
FIG. 19 is another perspective internal view of a cellar trailer of the present disclosure, according to one or more embodiments.
Figure 20:
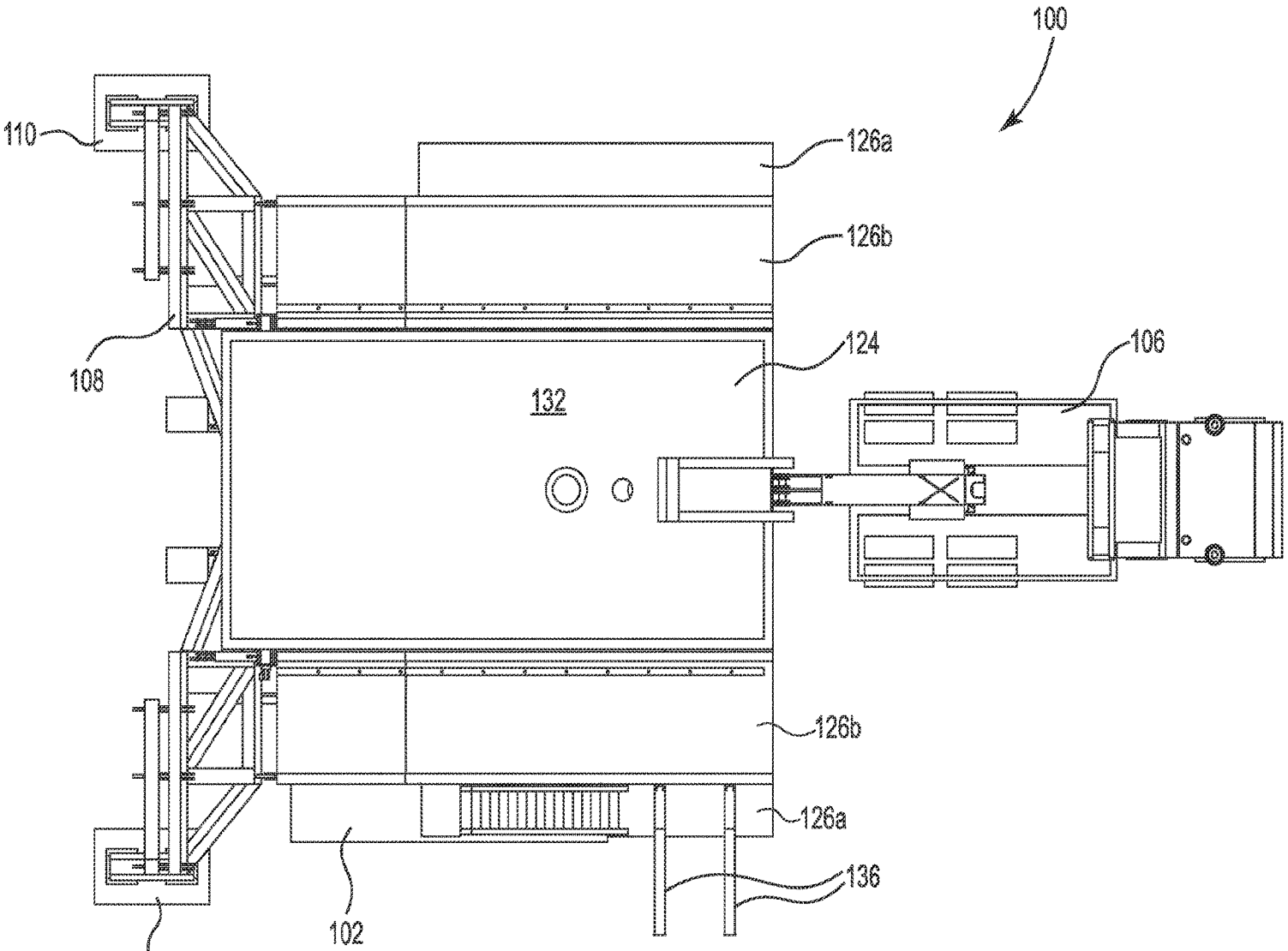
FIG. 20 is an overhead view of a cellar trailer of the present disclosure, according to one or more embodiments.

As shown in FIGS. 7 and 8, one or more subassemblies 126 may be arranged around the mezzanine 124. The subassemblies 126 may include one or more enclosures. For example, one or more subassembly enclosures **126*a*, 126*b* may be arranged adjacent to the mezzanine 124 and along an outside of a wall portion 130 of the mezzanine. In some embodiments, one or more subassembly enclosures 126*a*, 126*b* may be arranged along each of two wall 130 portions of the mezzanine 124. The subassembly enclosures 126*a*, 126*b* may provide additional work areas and/or equipment storage space beyond the mezzanine 124. Each subassembly enclosure 126*a*, 126*b* may be divided into multiple rooms or work or storage areas. In some embodiments, one or more subassembly enclosures 126*a*, 126*b* may be configured to be sealed or partially sealed, and in some cases, may provide a climate controlled or heated environment. In some embodiments, a wall portion 130 of the mezzanine 124 may form an inner wall of the one or more subassembly enclosures 126*a*, 126*b*. In some embodiments, the subassembly enclosures 126*a*, 126*h* may be arranged in a stacked configuration to provide multiple levels of work or storage space. For example, FIGS. 10-14 show various views of a lower level subassembly enclosure 126*a* and an upper level subassembly enclosure 126*b* arranged on each of a driller side and an off-driller size of the mezzanine 124. FIGS. 15 and 16 show the lower level subassembly enclosures 126*a* with respect to the mezzanine 124. As shown, the lower level subassembly enclosures 126*a* may be arranged with floor portions that are at a different height than the floor portion 128 of the mezzanine 124. FIGS. 17 and 18 show the upper level subassembly enclosures 126*b* with respect to the mezzanine 124. In some embodiments, a ceiling portion of one or more lower level subassembly enclosures 126*a* may provide or partially provide a floor portion of one or more upper level subassembly enclosures 126*b*. In some embodiments, the various enclosures may have different sizes. FIGS. 19 and 20** show an additional view of the mezzanine 124 and upper 126*b* and lower 126*a* subassembly enclosures without the ceiling portion 132 or the mezzanine. It may be appreciated that in other embodiments, subassembly enclosures may be arranged differently with respect to one another and/or with respect to the mezzanine 124. For example, the enclosures may be arranged to provide only one level or more than two levels. In some embodiments, subassembly enclosures may be arranged on more, fewer, or different wall portions 130 of the mezzanine 124 than those shown in FIGS. 7-20.

In some embodiments, one or more crane rails 136 may extend through an opening of the housing 102 in order to provide means for moving equipment into and out of the housing. For example, as shown in FIG. 9, one or more crane rails 136 may extend from the mezzanine 124, through a wall portion 130 on a driller or off-driller side, and through a subassembly enclosure 126*a*, 126*b*, to extend beyond the housing 102. This may allow workers to move equipment to and from the mezzanine 124 from outside of the trailer 100. In other embodiments, other handling and/or hoisting equipment or other mechanisms may be used to transport equipment to and from the housing 102. FIGS. 17-20 additionally show the crane rails 136.

In some embodiments, the housing 102 may be configured to couple to a drill floor of a drilling rig. That is, the ceiling portion 132 of the mezzanine 124, for example, may be configured to abut an underside of the drill floor when the trailer 100 is arranged beneath the drill floor. In this way, the ceiling portion 132, or another component arranged thereon, may have a relatively flattened surface configured to receive and/or abut the drill floor. Additionally, the housing 102 may be configured to couple to the drill floor via one or more hydraulic pins and/or other suitable coupling mechanisms. In some embodiments, the ceiling portion 132 of the mezzanine may operate as a drip pan when beneath the drill floor.

Figure 21:
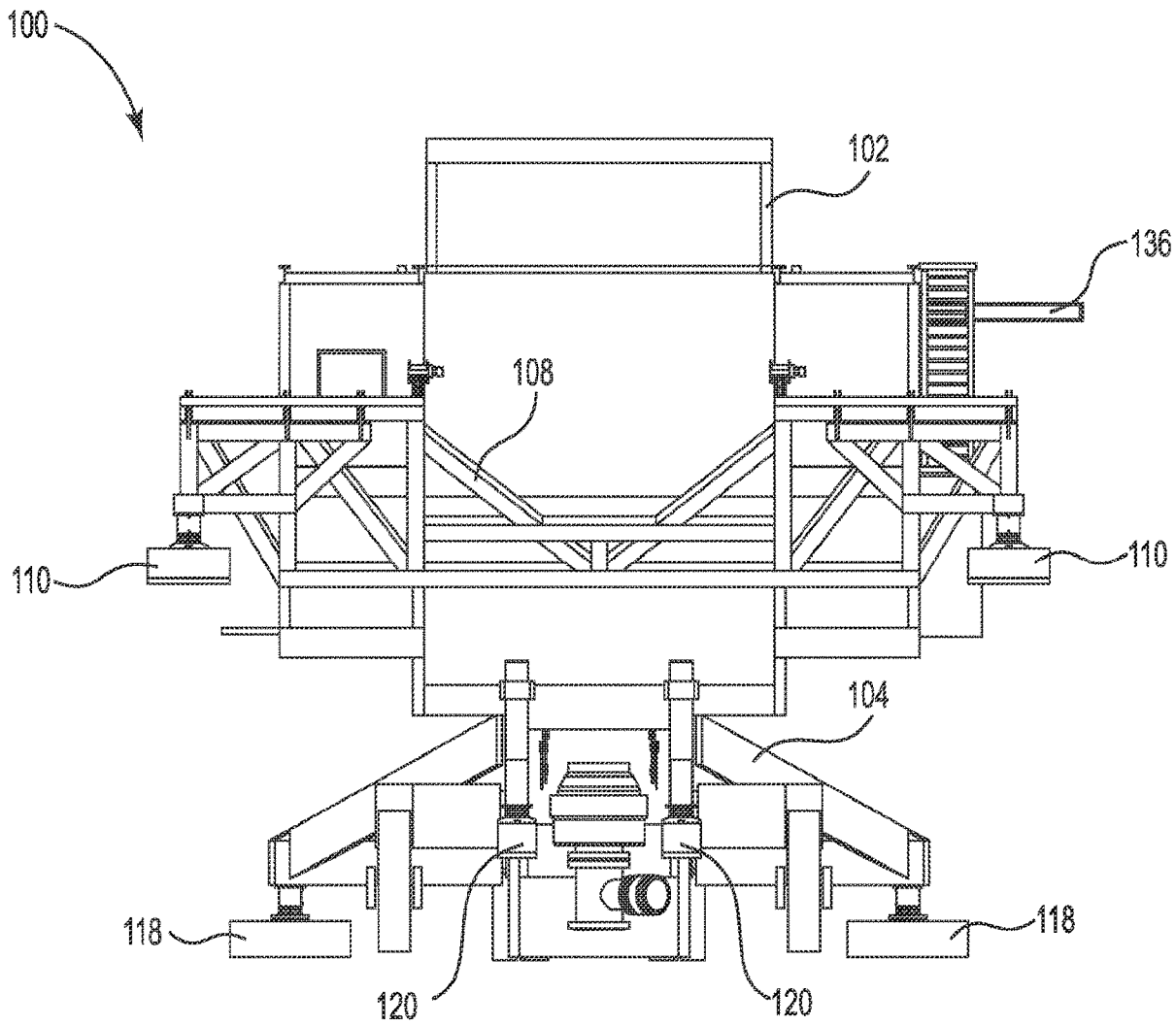
FIG. 21 is a rear end view of a cellar trailer of the present disclosure, according to one or more embodiments.

In some embodiments, the cellar trailer 100 may have a shear wall 108, such as a truss shear wall, configured to extend between the trailer and a ground or pad surface in order to provide stiffening support to the drill floor above the trailer during drilling operations. The shear wall 108 is shown, for example, in FIG. 21 (see also FIG. 3). The shear wall may be comprised of a plurality of trusses in some embodiments. The shear may couple to the housing 102 or to another portion of the trailer 100 and may be configured to extend between the trailer and a ground or pad surface. In some embodiments, the shear wall 108 may extend from a rear end of the trailer 100, opposite the tow end of the trailer, and may extend rearward from the trailer. The wall 108 may have a width spanning across the width of the housing 102 or trailer 100, or a portion thereof. The shear wall 108 may have a height configured to extend between its point of attachment to the housing 102 or trailer 100 and the ground or pad surface. It may be appreciated that the shear wall 108 may be configured to be used in place of conventional stiffening legs in order to support the drill floor during drilling operations in some embodiments. The shear wall 108 may be configured to be arranged in more than one position, such as a roading position and a drilling position. In the roading position, as shown in FIG. 21, the wall 108 may be configured to fold and/or pivot upward away from the ground or pad surface. In the drilling position, the wall 108 may fold and/or pivot downward such that it may be arranged between the trailer 100 and ground or pad surface. The wall 108 may be configured such that, when arranged in the drilling position, it may accommodate or arch over the inner bearing feet 120, tires 122, and/or other equipment. In this way, the shear wall 108 may be configured to have a width extending beyond the inner bearing feet 120, tires 122, and/or other equipment. In some embodiments, the wall 108 may have two portions, such as a driller side portion and an off-driller side portion that may be configured to pivot and/or fold independently of one another. FIG. 18, for example, shows a first portion 108*a* of the shear wall arranged in a roading position and a second portion 108*b* of the shear wall arranged in a drilling position. In some embodiments, the wall 108 may have one or more bearing pads 110. For example, each portion 108*a*, 108*b* of the wall may have a bearing pad 110. In other embodiments, the shear wall 108 may have a single bearing pad, or any other suitable number of bearing pads.

Figures 22A, 22B, 22C, 22D, 22E, 22F:
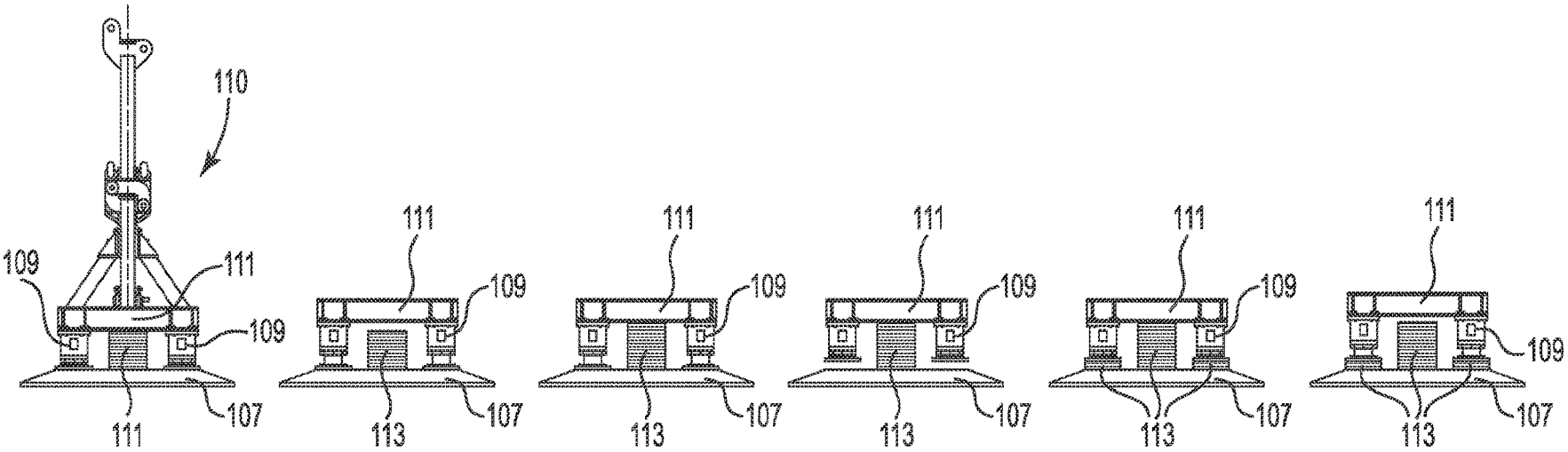
FIG. 22A is a side view of a shear wall bearing pad of the present disclosure with plates arranged beneath the bearing pad, according to one or more embodiments.
FIG. 22B is another side view of the bearing pad of FIG. 22A, with hydraulic cylinders extended, according to one or more embodiments.
FIG. 22C is another side view of the bearing pad of FIG. 22.4, with additional plates arranged beneath the pad, according to one or more embodiments.
FIG. 22D is another side view of the bearing pad of FIG. 22A, with hydraulic cylinders retracted, according to one or more embodiments.
FIG. 22E is another side view of the bearing pad of FIG. 22A, with plates arranged beneath the hydraulic cylinders, according to one or more embodiments.
FIG. 22F is another side view of the bearing pad of FIG. 22A, with hydraulic cylinders extended, according to one or more embodiments.

Each hearing pad 110 may be configured to transfer load from the drill floor, through the shear wall 108, and to the ground or pad surface. In some embodiments, the bearing pads 110 may each be hydraulically coupled to the shear wall 108 via one or more hydraulic cylinders. In this way, each bearing pad 110 may be extended or retracted with respect to the shear wall 108. This may help to span the length between the trailer 100 and ground or pad surface. In some embodiments plates, such as steel plates may be arranged beneath the bearing pads 110. For example, FIG. 22A shows a bearing pad 110 having two hydraulic cylinders 109, and a plurality of steel plates 113 arranged beneath a center portion 111 of the bearing pad. In the event that the pad or ground surface experiences settlement during drilling operations, the hydraulically controlled bearing pads 110 and steel plates 113 may help to shim the space between the ground or pad surface and the bearing pads. FIGS. 22A-22F illustrate a series of steps in shimming space between a ground or pad surface 107 and a bearing pad 110. As shown in FIG. 22B, if the space between the ground or pad surface 107 and bearing pad 110 increases such as due to settlement, one or more hydraulic cylinders 109 of the bearing pad 110 may be extended. As shown in FIG. 22C, one or more additional steel plates 113 may be arranged beneath a center portion 111 of the bearing pad 110. As shown in FIG. 22D, the one or more hydraulic cylinders 109 may be retracted. As shown in FIG. 22E, one or more additional steel plates 113 may be arranged beneath the hydraulic cylinders 109. If settlement proceeds further, as shown in FIG. 22F, the one or more hydraulic cylinders 109 may be extended, such that additional steel plates 113 may be arranged beneath the center portion 111 of the bearing pad 110.

In use, a cellar trailer 100 of the present disclosure may be configured to support and house blowout preventer(s) and/or other well head equipment or other drilling equipment during drilling operations. It may be appreciated that the equipment supported by and housed within the cellar trailer 100 may weigh tens or hundreds of thousands of pounds. In a conventional drilling operation, this equipment is stored on or supported by the drilling rig itself. By housing such equipment in a separate modular cellar trailer, the drilling rig is made significantly lighter when the two are separated for transport. In some embodiments, the cellar trailer 100 may support and house up to half the equipment load conventionally stored on the rig. The lighter rig may more readily conform to desired tire capacities or other weight limits or loading capacities. Moreover, the lighter rig may provide for safer conditions when driven over ice roads. In some embodiments, the cellar trailer 100 may additionally help to transfer loading from drilling operations to the ground. The cellar trailer 100 may additionally provide stiffening support to the drill floor by way of the shear wall 108. In this way, it may be appreciated that stiffening legs conventionally used to support the drill floor may not be needed, further reducing weight or load on the drill rig.

Figure 23:
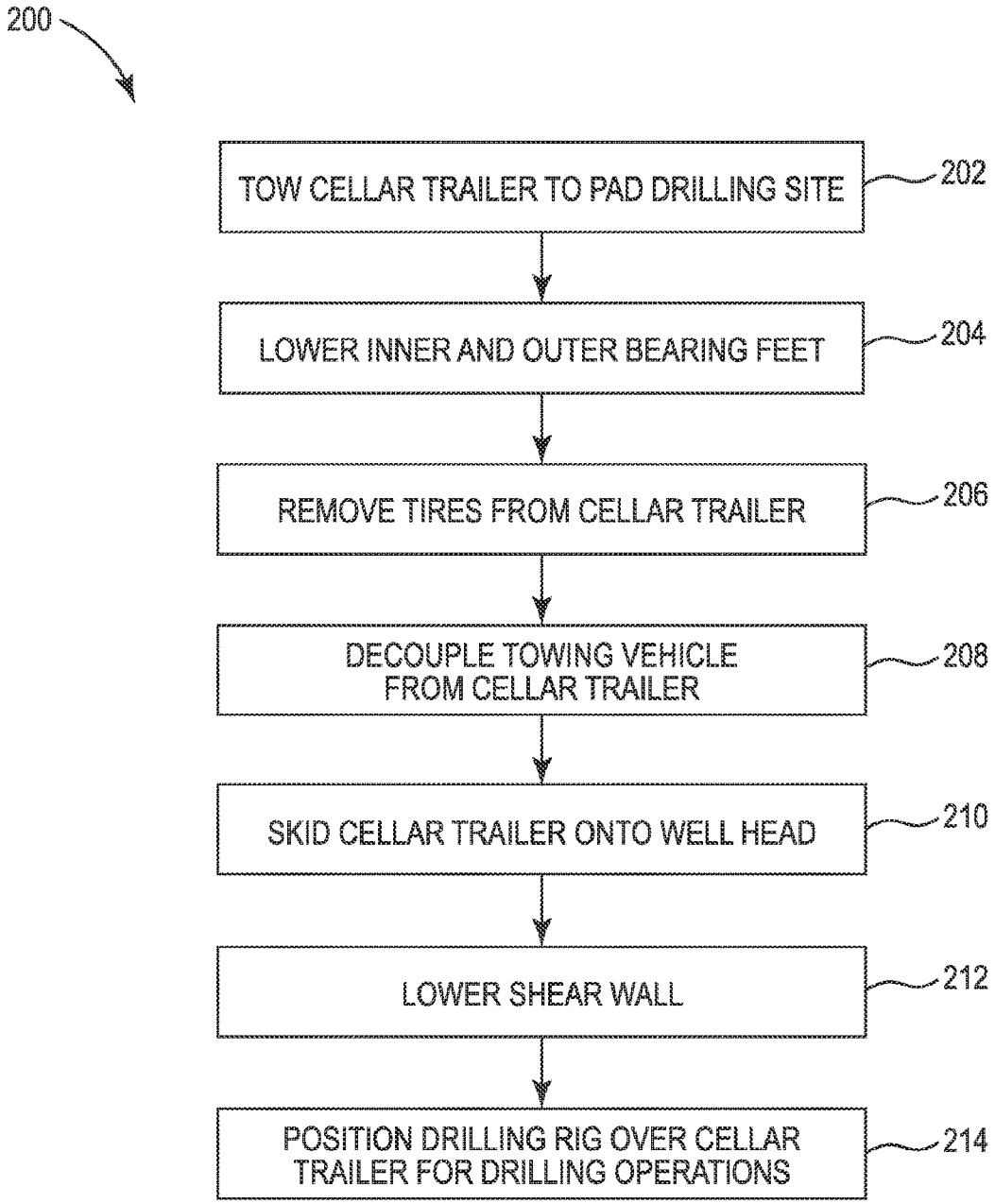
FIG. 23 is a flow diagram of a method of using a cellar trailer of the present disclosure, according to one or more embodiments.

FIG. 23 illustrates a method 200 of using a cellar trailer of the present disclosure, according to one or more embodiments. The method 200 may include towing the cellar trailer to a drilling site (202); lowering the inner and outer bearing feet (204); removing the tires from the trailer (206); decoupling the trailer from the towing vehicle (208); skidding the trailer onto a well head (210); lowering the shear wall (212); and positioning a drilling rig over the cellar trailer for drilling operations (214).

Figure 24:
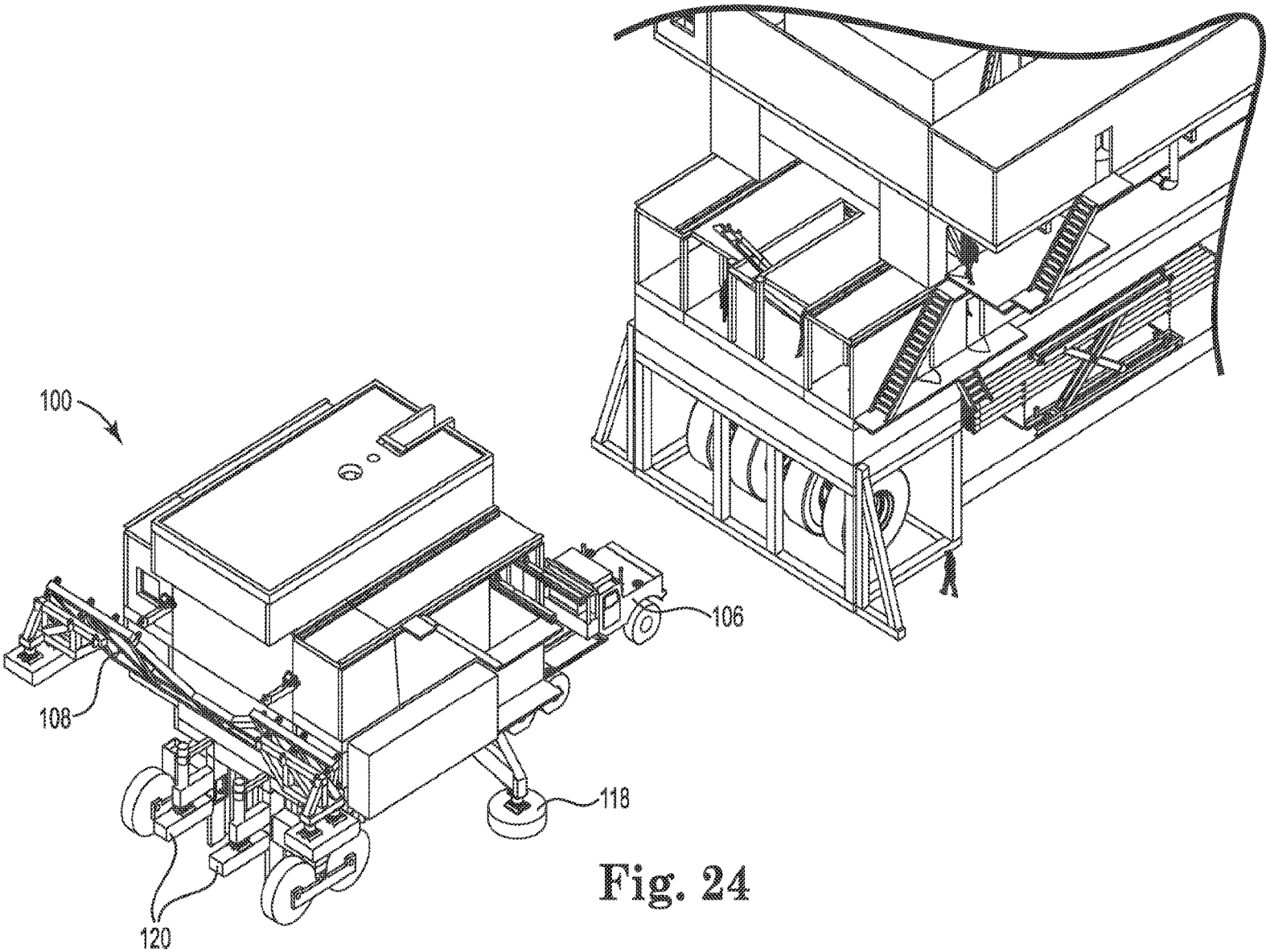
FIG. 24 is a perspective view of a cellar trailer of the present disclosure, according to one or more embodiments.

Towing the cellar trailer to a drilling site (202) may include coupling the trailer 100 to a towing vehicle 106, such as a truck or tractor, via the hitch 112. The trailer 100 may be towed to a drilling site, such as a pad drilling site having one or more well heads. While the trailer 100 is being towed, the bearing feet 118, 120, shear wall 108, and/or other equipment may be in a roading position. FIG. 24 illustrates the trailer 100 with inner and outer bearing feet 120, 118 and shear wall 108 in a roading position, and coupled to a towing vehicle 106 for towing. It may be appreciated that in other embodiments, the trailer 100 may have its own drive system, such that it may be independently drivable without the need for a towing vehicle.

Figure 25:
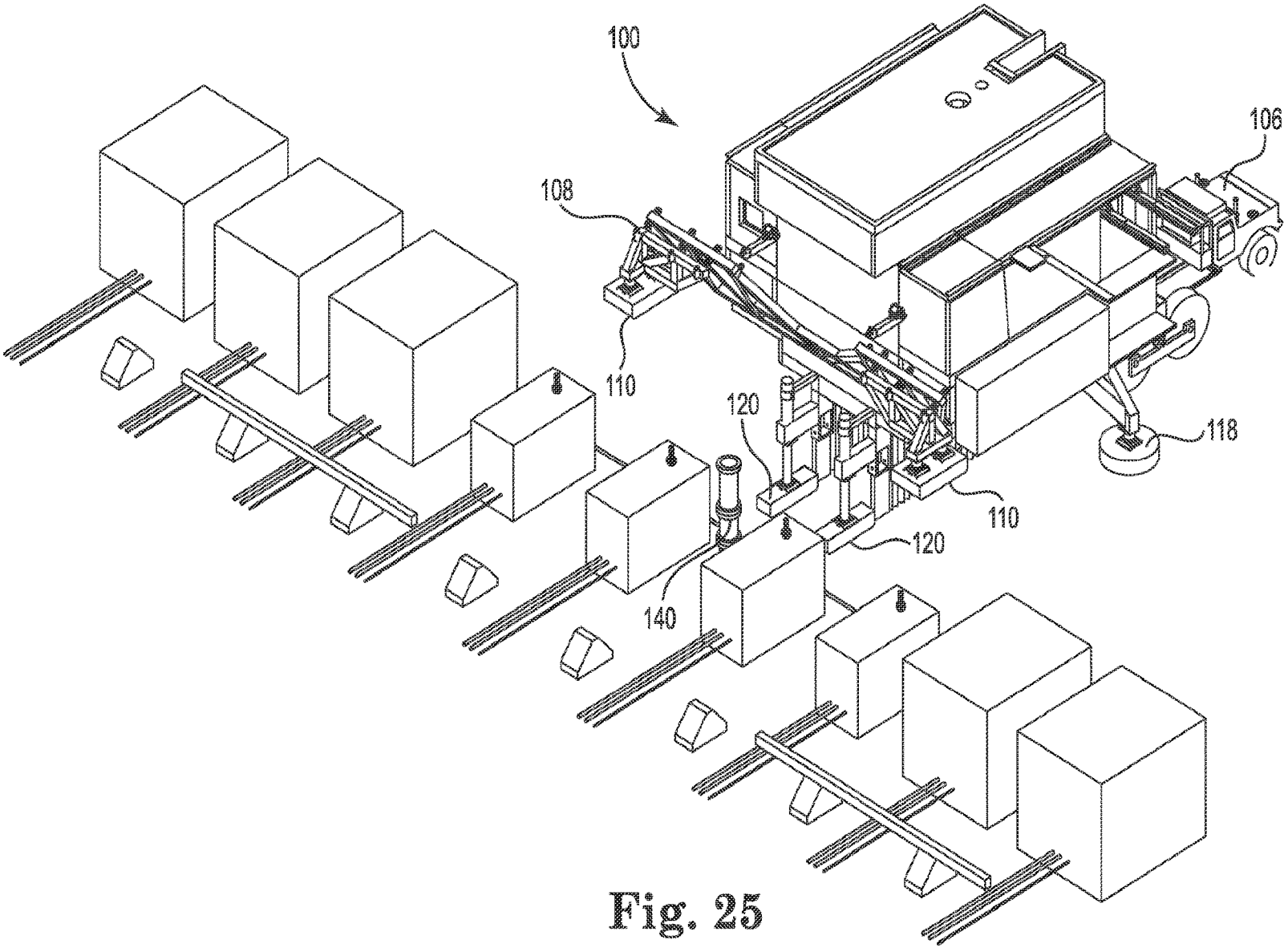
FIG. 25 is a perspective view of a cellar trailer of the present disclosure being towed to a well head and in a drilling position, according to one or more embodiments.

Once at a drilling site and near a well head, the trailer 100 may be prepared for skidding onto the well head, as shown in FIG. 25. For example, the inner 120 and outer 118 bearing feet may be lowered to the ground level (204). In some embodiments, the tires 122 may be removed from the trailer 100 (206). The trailer 100 may be decoupled from the towing vehicle 106 (208). This may include, for example, using the inner 120 and outer 118 bearing feet to jack the trailer 100 up, so as to allow the hitch 112 to be decoupled from the towing vehicle 106.

Once on the inner 120 and outer 118 bearing feet, the trailer 100 may be walked or skidded onto a well head 140 (210) using walking feet or another other movement mechanism(s). The trailer 100 may be positioned on the well head 140 such that the well head is positioned in the lower cellar area 115 of the trailer.

Figure 26:
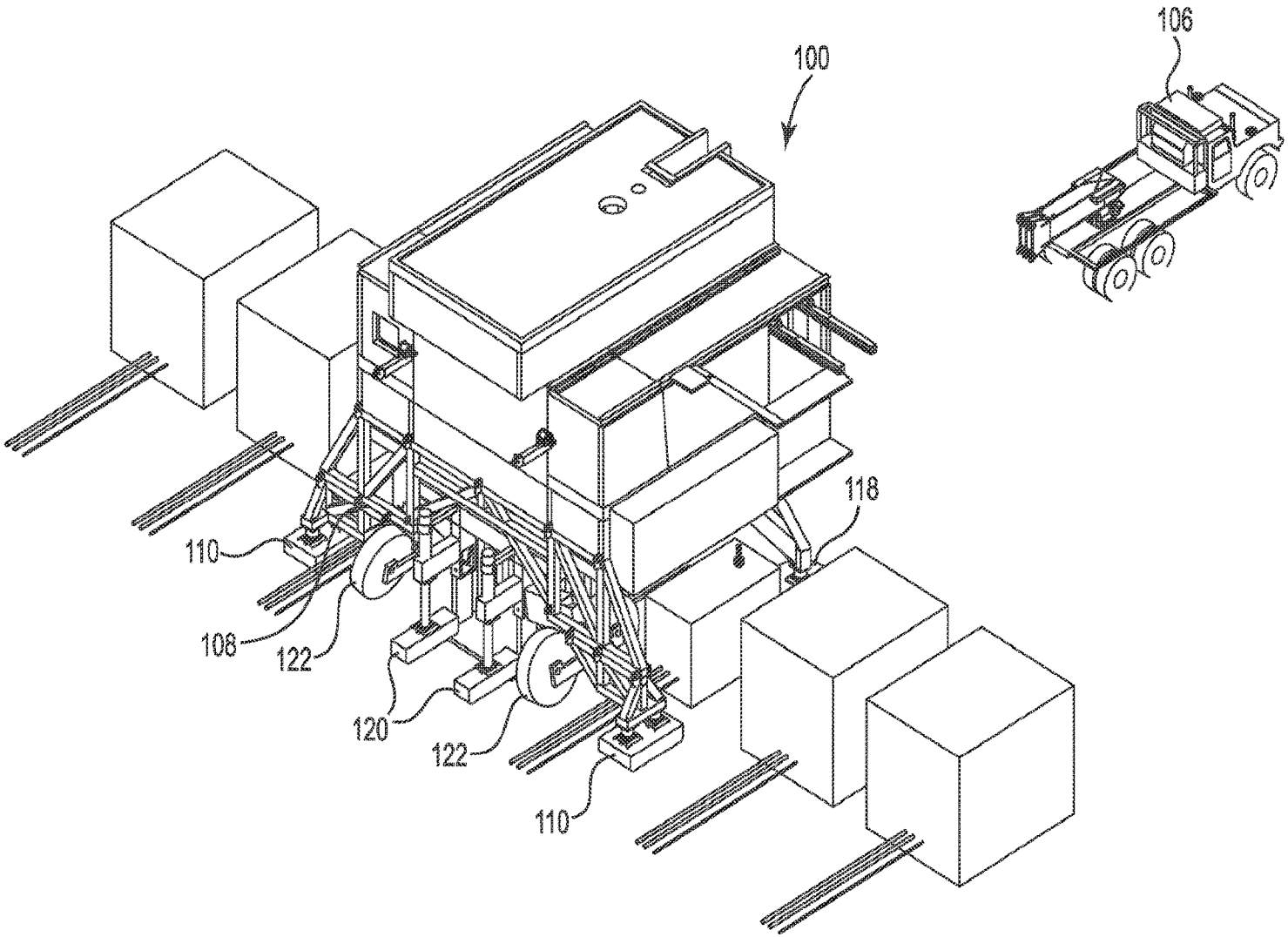
FIG. 26 is a perspective view of a cellar trailer of the present disclosure arranged over a well head.

In addition, the shear wall 108 may be lowered to the drilling position (212). As shown in FIG. 26, the shear wall 108 may be lowered and/or unfolded to positioned the bearing pads 110 on the ground or pad surface, such that the wall extends between the ground or pad surface and the trailer 100. It may be appreciated that the shear wall 108, bearing pads 110, and/or other components of the trailer 100 may be sized and arranged to accommodate any production piping 138 with respect to a well site.

Figure 27:
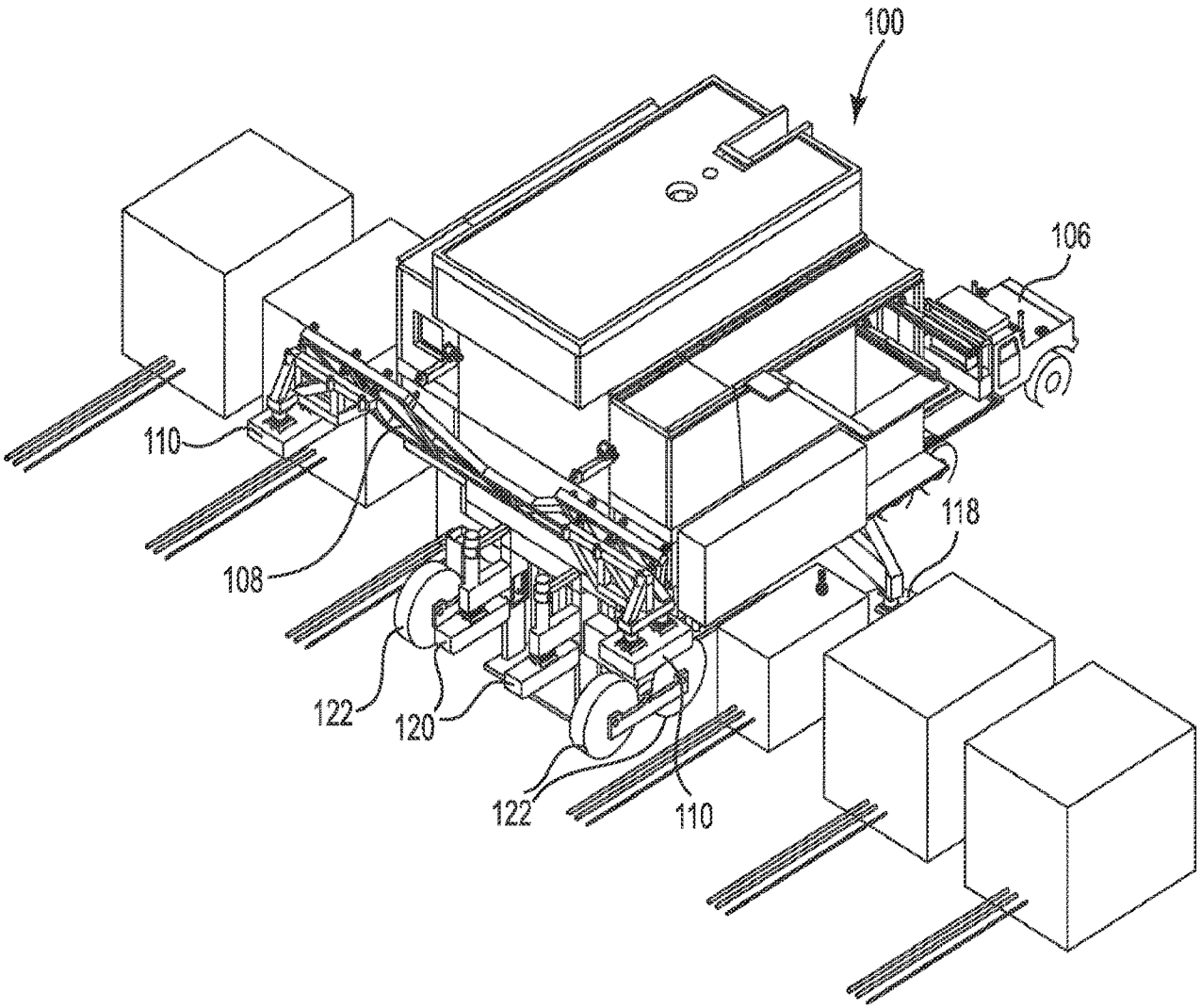
FIG. 27 is another perspective view of a cellar trailer of the present disclosure arranged over a well head and in a roading position, according to one or more embodiments.

In other embodiments, rather than skidding the trailer onto the well head 140, the trailer 100 may be towed (pushed) onto the well head using the towing vehicle 106, as shown in FIG. 27. In such cases, the inner 120 and outer 118 bearing feet and shear wall 108 may be lowered, and the towing vehicle 106 may be decoupled, after the trailer 100 is in position on the well head 140. The method (skidding or towing) used to position the trailer 100 on the well head 140 may depend in part on spacing surrounding the well head. For example, on a multi-well pad drilling site, limited space between wells may be such that towing or driving the trailer onto the well head 140 may be cumbersome or not feasible, and skidding operations may be more applicable.

In general, the trailer 100 may be arranged on the well head 140 before the drilling rig is in place. This may allow workers to begin testing the blowout preventer(s) and/or other equipment, and generally preparing the well head 140 for drilling operations before the drill rig arrives. It may be appreciated that this may help speed the drilling process with respect to the drill rig, at least because the well head 140, blowout preventer(s), and/or other equipment may already be prepared for drilling when the drill rig arrives at the drill site. The drill rig may be positioned over the well head 140 and over the trailer 100 (214), such that the drill floor may abut the trailer. The trailer 100 may be coupled to the drill rig via hydraulic pins or other suitable coupling mechanisms.

It may be appreciated that the steps of the method 200 may be generally reversed to remove the trailer 100 from the well head 140, such as after drilling operations are completed. For example, after drilling operations at the well are completed, the drilling rig may be decoupled from the trailer 100 and removed from the well site. The shear wall 108 may be raised. If the trailer 100 was towed onto the well head 140, the towing vehicle 106 may be coupled to the trailer 100, the bearing feet 118, 120 raised, and the trailer may be towed off of the well head. If, however, the trailer 100 was skidded onto the well head 140, the trailer may be skidded off of the well head via walking feet or other mechanisms. The trailer 100 may then be coupled to the towing vehicle 106, the tires 122 may be replaced if they were removed, and the bearing feet 118, 120 may be raised. The trailer 100 may be towed to a different well site or, in some embodiments, to a different well on the pad.

Figure 28:
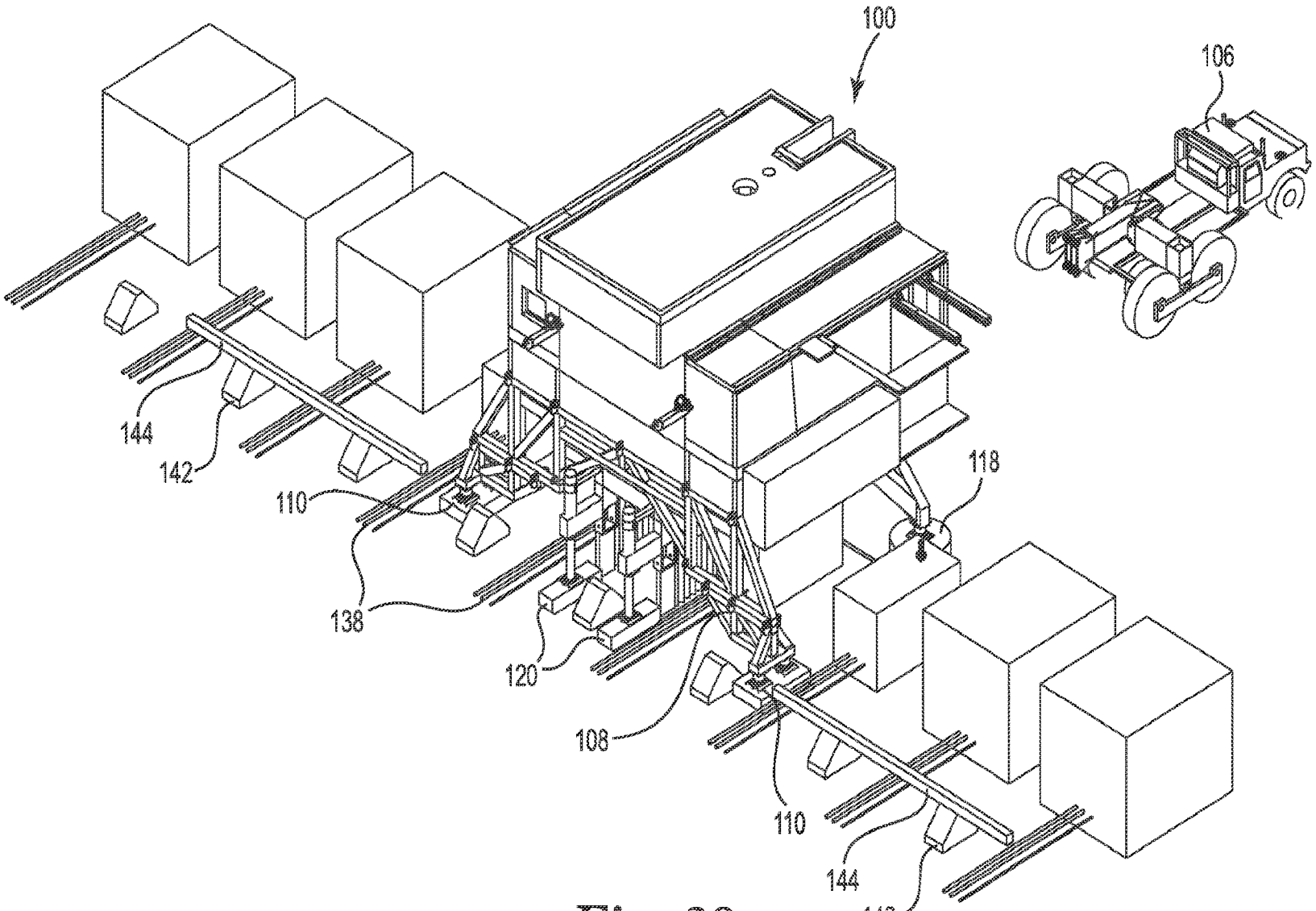
FIG. 28 is a perspective view of a cellar trailer of the present disclosure arranged over a well head and in a drilling position, according to one or more embodiments.
Figure 29:
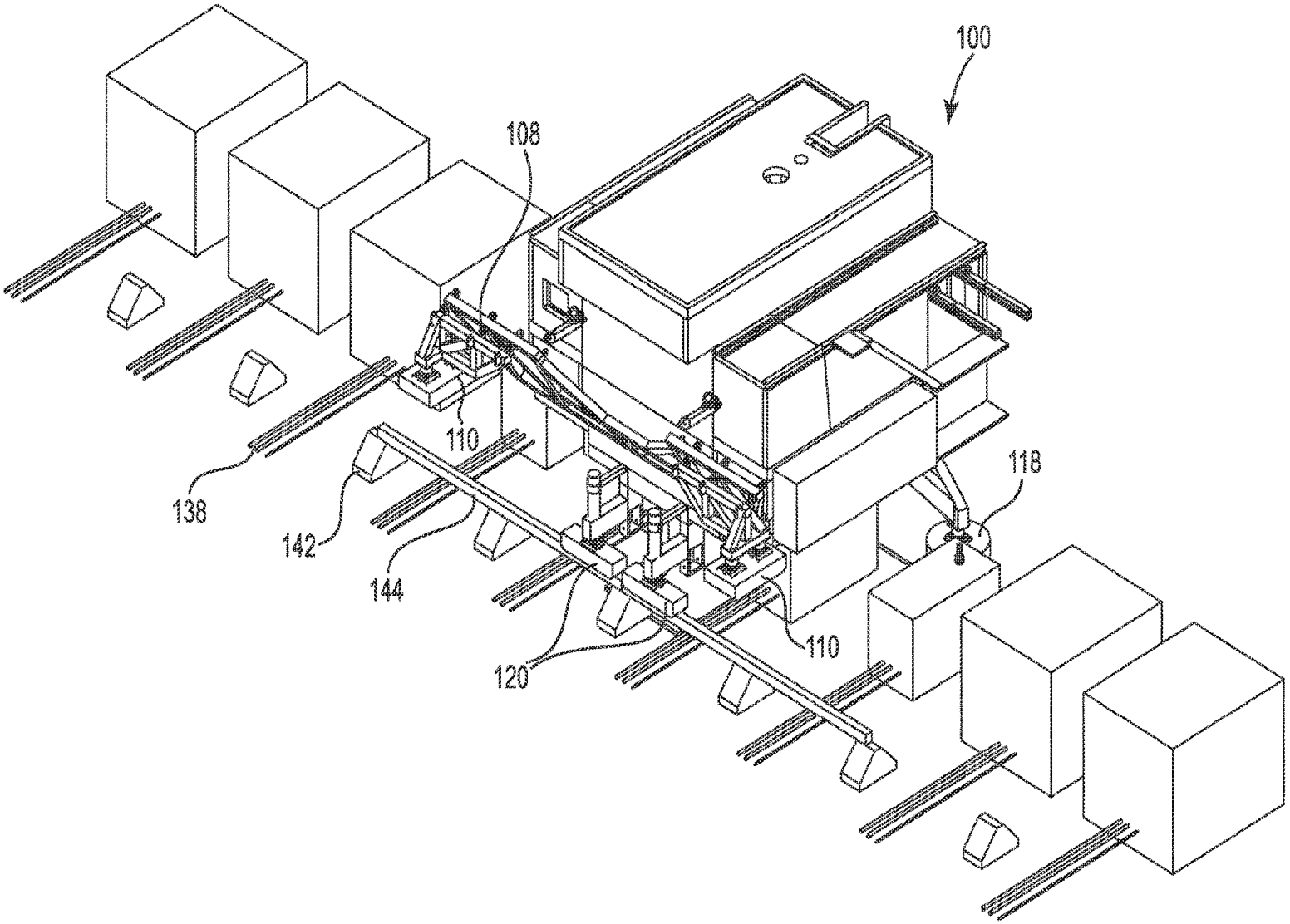
FIG. 29 is a perspective view of a cellar trailer of the present disclosure arranged over a well head and in a skidding position, according to one or more embodiments.

In some embodiments, a cellar trailer 100 of the present disclosure may be configured to skid perpendicular to a direction of towing travel. For example, on a multi-well pad drilling site, the trailer 100 may be configured to skid along a row of wells in order to efficiently move along the row of well heads. Turning to FIG. 28, in some embodiments, a modular rail comprising a plurality of rail sections 144 may be arranged on the production piping 138 side of a row of well heads. In some embodiments, the rail sections 144 may be arranged on and supported by a plurality of sawhorses 142 configured to support the rail above the production piping 138, or generally above the ground or pad surface. The modular rail sections 144 may be pinned together and/or pinned to the sawhorses 142. To move to a next well in the row of wells, the inner bearing feet 120 may be arranged on the rail, the shear wall 108 may be raised, and the trailer 100 may be skidded, via walking feet or another mechanism(s), to a next well in the row, as shown in FIG. 29.

Figure 30:
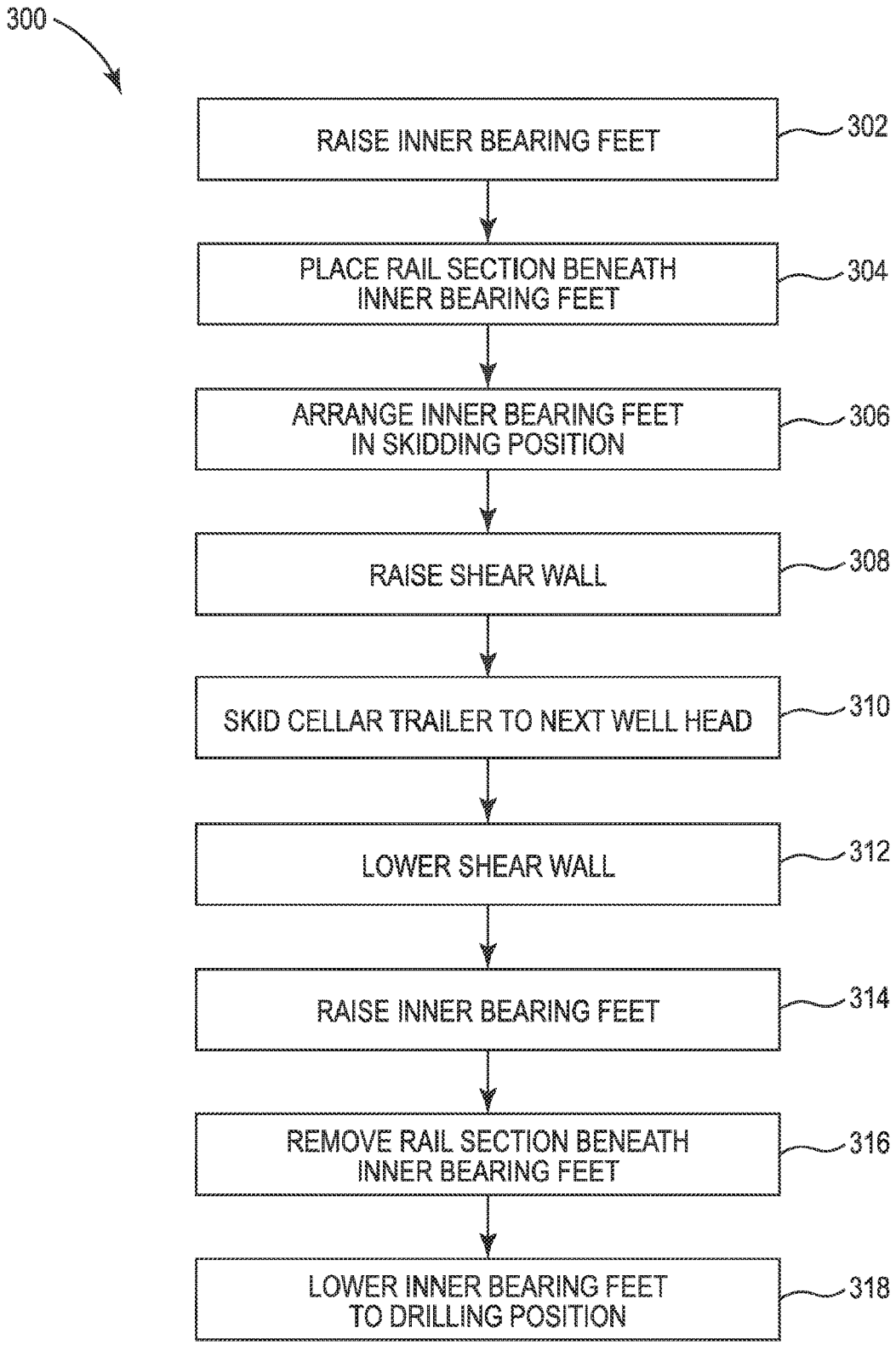
FIG. 30 is a method of skidding a cellar trailer of the present disclosure, according to one or more embodiments.

FIG. 30 provides a method 300 of skidding a cellar trailer 100 from a first well to a second well in a row of wells. The method may include raising the inner bearing feet 120 (302); placing a rail section 144 beneath the inner bearing feet (304); arranging the inner bearing feet in a skidding position on the rail (306); raising the shear wall 108 (308); skidding the trailer 100 to a next well head (310); lowering the shear wall (312); raising the inner bearing feet (314); removing a rail section from beneath the inner bearing feet (316); and lowering the inner bearing feet to a drilling position (318). It may be appreciated that before the trailer 100 is moved from a first well to a second well, the drilling rig may be decoupled from and removed from the well.

Raising the inner bearing feet 120 (302) may include hydraulically raising the inner bearing feet high enough such that a rail section 144 may be placed beneath them. While the inner bearing feet 120 are raised, the dead load of the trailer 100 may be supported by the shear wall 108 and the outer bearing feet 118. With the inner bearing feet 120 raised, a rail section 144 may be arranged behind the trailer 100 and beneath the inner bearing feet 120 (304). The rail section 144 may be arranged on one or more sawhorses 142, as shown in FIG. 28. The inner bearing feet 120 may be arranged in a skidding position on the rail section 144 (306). To reach the skidding position, the inner bearing feet 120 may be rotated in some embodiments in order to engage the rail section 144. For example, the inner bearing feet 120 may be rotated approximately 90 degrees in some embodiments. The rotated bearing feet 120 may be lowered onto the rail section 144 to engage the rail. In other embodiments, the inner bearing feet 120 may engage the rail without the need for rotation. Once the inner bearing feet 120 are in the skidding position, the shear wall 108 may be raised to a roading position. In some embodiments, outer rail sections 144 may be removed or rolled back to allow for a swing radius of the shear wall 108. However, in other embodiments, the shear wall 108 may be positioned such that it may extend beyond where the rail is positioned such that the rail need not be moved to accommodate raising or lowering of the shear wall.

With the shear wall 108 raised, the dead load of the trailer 100 may be supported by the inner 120 and outer 118 bearing feet. The trailer 100 may be skidded to a second well head (310) using, for example, walking feet or other movement mechanism(s). As the walking feet operate to move the trailer 100, the inner bearing feet 120 may be configured to slide or walk along the rail. Once the second well head is reached, the trailer 100 may be positioned once again for drilling operations. The shear wall 108 may be lowered to a drilling position (312). In some embodiments, outer rail sections 144 may be removed or rolled away so as to accommodate a swing radius of the shear wall 108. The inner bearing feet 120 may be raised (314), and the rail section 144 immediately behind the trailer 100 and under the inner bearing feet 120 may be removed (316). The inner bearing feet 120 may be rotated and/or lowered back to a drilling position (318).

Figure 31:
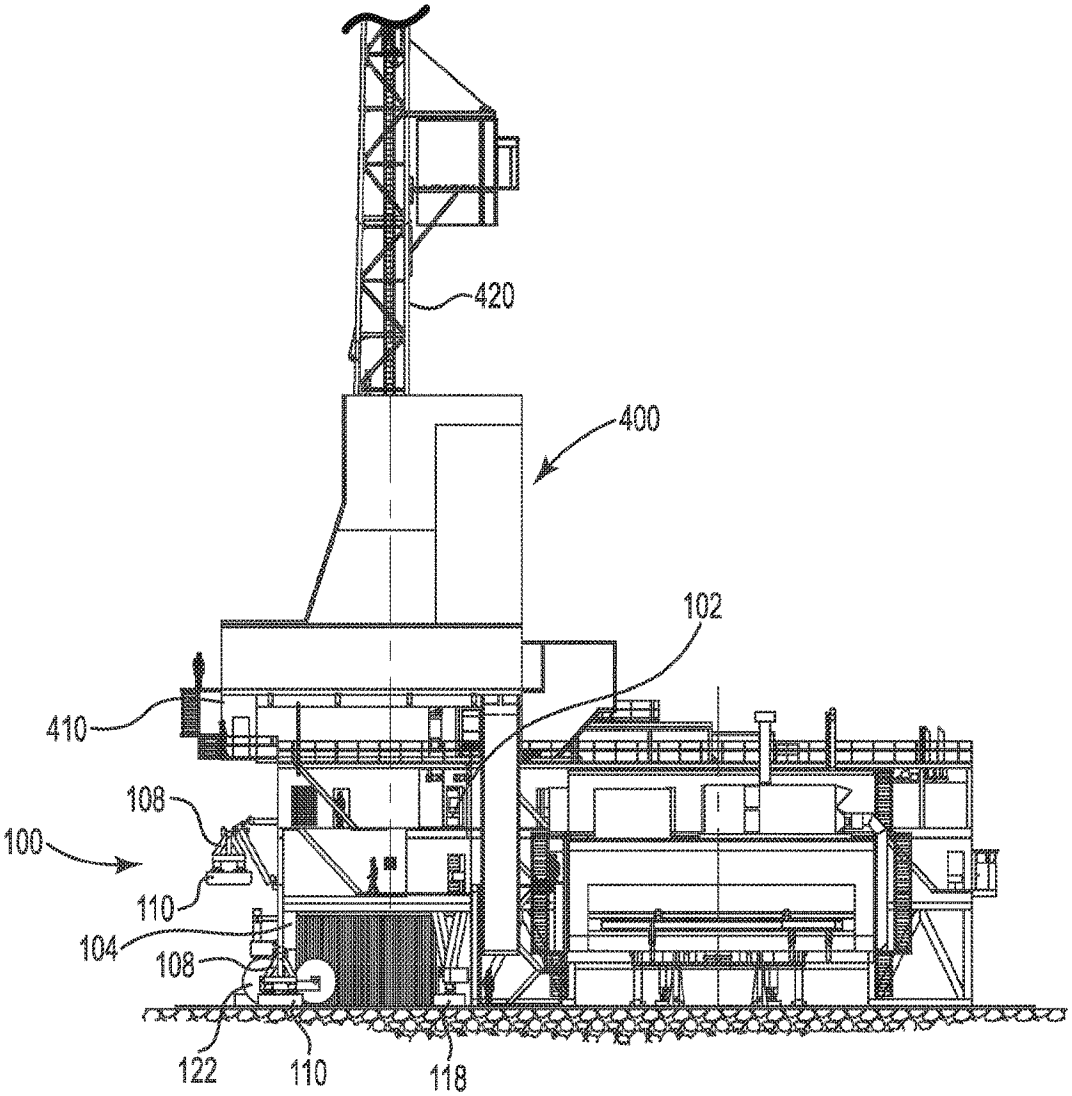
FIG. 31 is a side view of a drilling rig and cellar trailer of the present disclosure, according to one or more embodiments.
Figure 32:
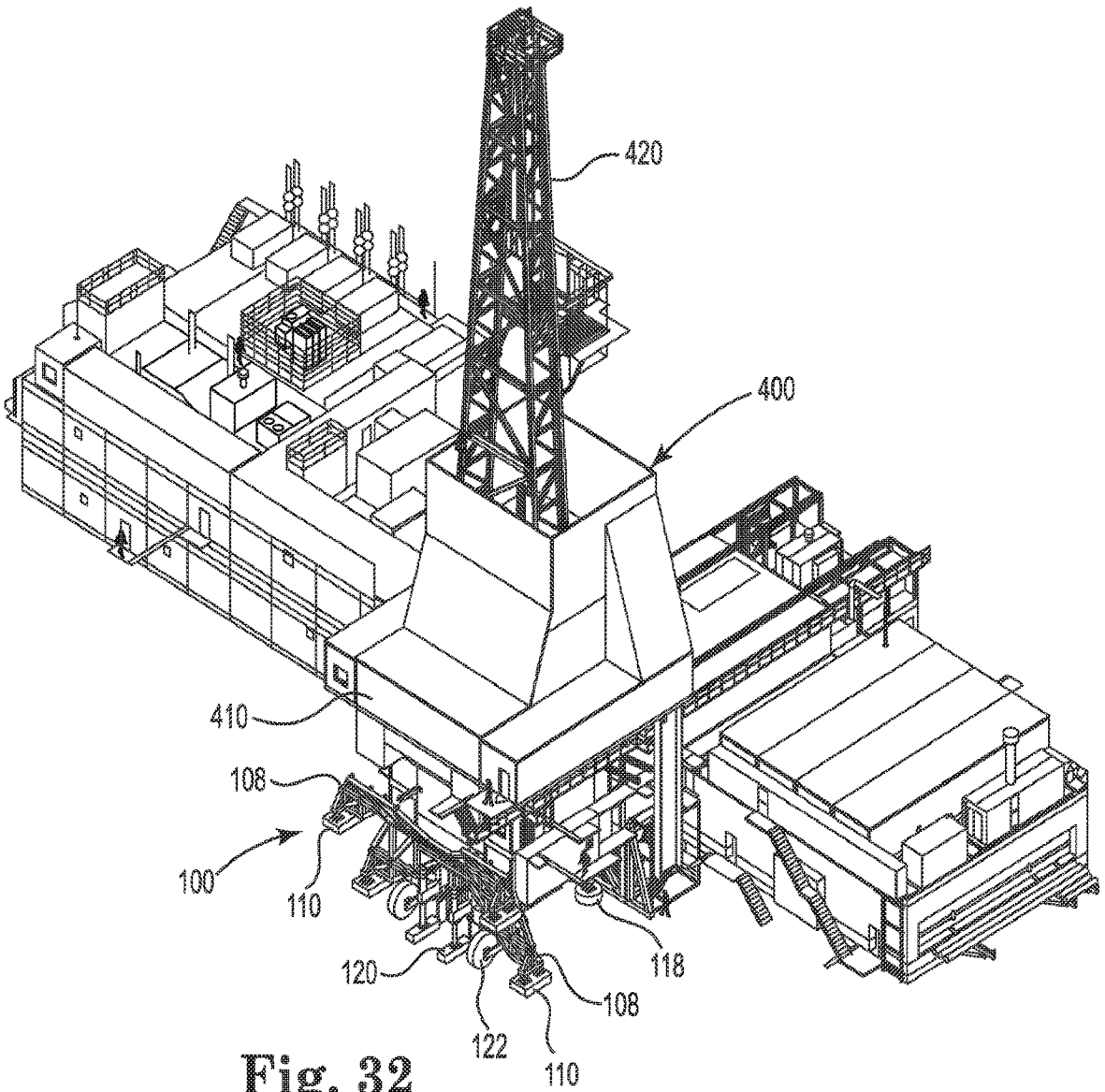
FIG. 32 is a perspective view of a drilling rig and cellar trailer of the present disclosure, according to one or more embodiments.
Figure 33:
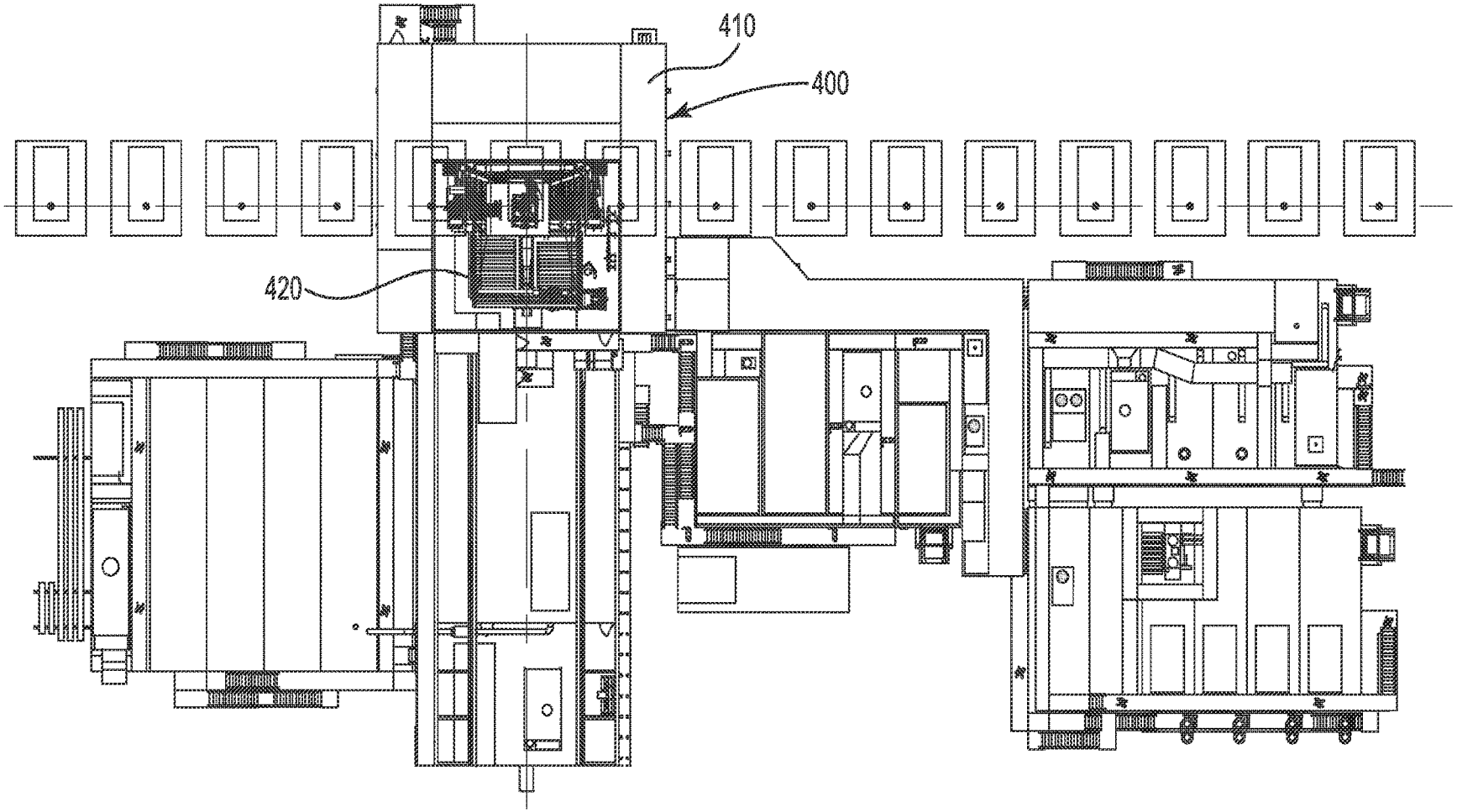
FIG. 33 is an overhead view of a drilling rig and cellar trailer of the present disclosure, according to one or more embodiments.
Figure 34:
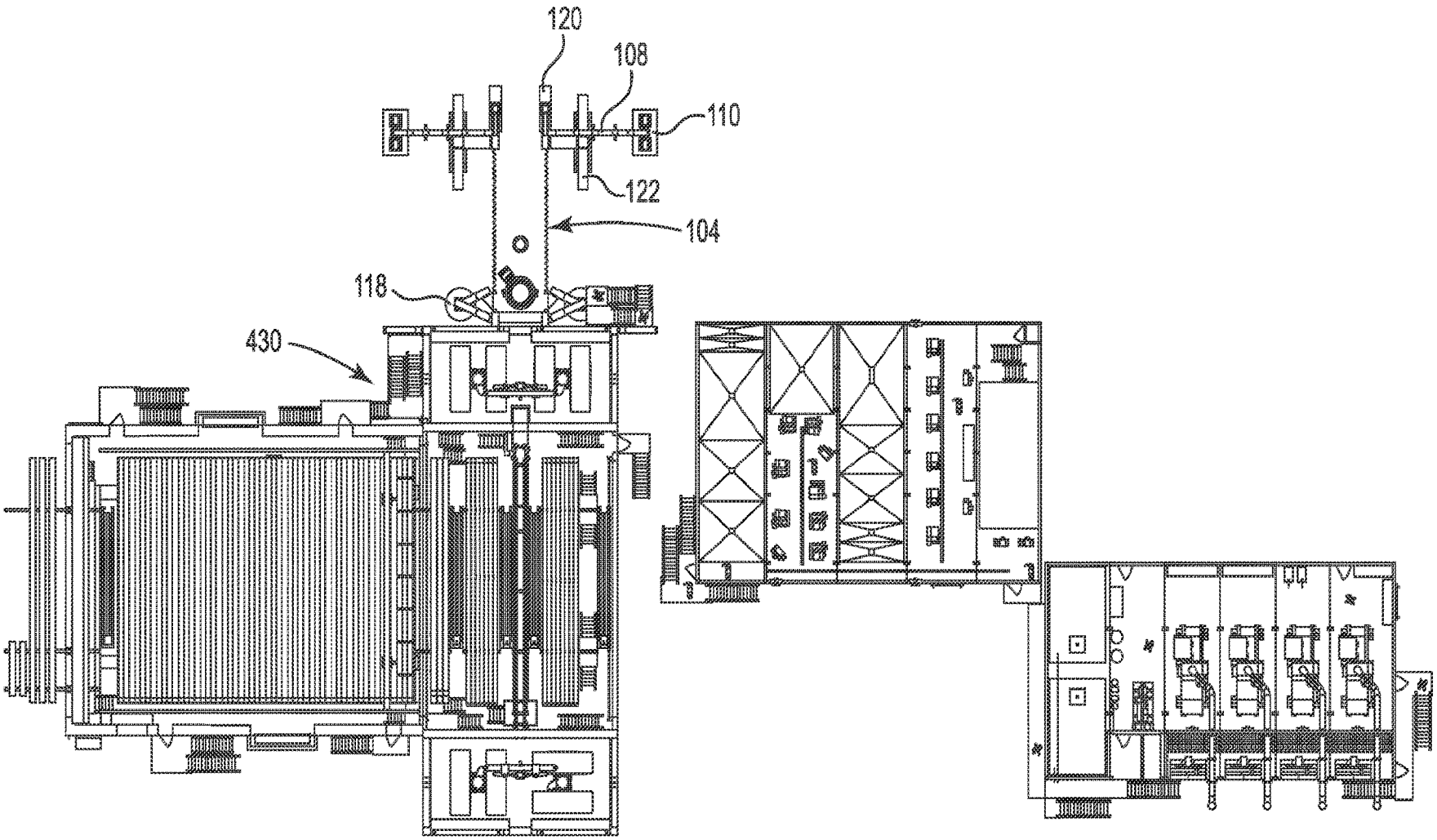
FIG. 34 is an overhead view of a drilling rig frame portion and a cellar trailer frame of the present disclosure, according to one or more embodiments.

FIGS. 31-33 show a cellar trailer 100 of the present disclosure in place over a well with a drilling rig 400. As shown, the drilling rig 400 may have a cantilevered drill floor 410 extending out over the trailer 100 and supporting a drilling mast 420. The trailer housing 102 and/or frame 104 may be coupled to the drilling rig 400 by hydraulic pins and/or other attachment means. In FIGS. 31 and 32, the shear wall 108 is shown in both a roading position and a drilling position. As described above, in the drilling position, the shear wall 108 may provide stiffening support to the drill floor 410. It may be appreciated that the trailer 100 may operate as part of the drilling rig structure when coupled to the drilling rig 400 and/or during drilling operations. FIG. 34 shows the frame 104 of the trailer 100 in place over a well with respect to a frame portion 430 of the drilling rig 400.

It may be appreciated that a cellar trailer of the present disclosure may generally accelerate drilling operations. In some embodiments, use of a cellar trailer may accelerate rig up and rig down time, at least because a cellar trailer may begin prepping operations before a drilling rig arrives or is ready to drill, and may continue closing drilling operations after or during rig down time of the drilling rig. In some embodiments, multiple cellar trailers may be used to further increase drilling efficiency. For example, on a multi-well pad drilling site, two cellar trailers may be used, such that one cellar trailer may be preparing a next well or closing down a previous well while another cellar trailer is engaged in drilling operations with a drilling rig. This may allow the drilling rig to move efficiently from well to well without waiting for preparation or closing operations before and after drilling.

As described above, a cellar trailer of the present disclosure may significantly reduce loading on a drilling rig by providing a separate modular structure for blowout preventer(s) and/or other well head or other equipment. This may be particularly beneficial in Arctic drilling, where ice roads require strict bearing limitations. Additionally, a cellar trailer of the present disclosure may provide support for a drill floor, such as a cantilevered drill floor, and thus may operate as part of the drilling rig structure during drilling operations. This may reduce or eliminate the need for stiffening legs conventionally used with cantilevered drill floors, which may further reduce the weight on the drill rig itself. It may be appreciated that a cellar trailer of the present disclosure may be useable with other types of drilling rigs beyond cantilevered rigs. Additionally, the benefits provided by a cellar trailer of the present disclosure may be realized with respect to drilling operations in regions other than Arctic or icy regions.

Various embodiments of the present disclosure may be described herein with reference to flowchart illustrations and/or block diagrams of methods or apparatus (systems). Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A method of drilling, the method comprising:

towing a first cellar trailer for arrangement on a well head in conjunction with a self-supporting drill rig to a drilling site, the first cellar trailer comprising:

a first housing for storing well head equipment; and a first frame coupled to and supporting the first housing;

wherein, the first frame and the first housing are sized, shaped, and configured for removable placement over a first well head, below a drill floor of the self-supporting drill rig, and amidst a substructure of the self-supporting drill rig;

positioning the first cellar trailer over the first well head and preparing the first well head for drilling operations prior to arrival of the self-supporting drill rig; and positioning the drill rig such that a substructure of the drill fig supports the drill floor in a cantilevered condition over the first cellar trailer.

2. The method of claim 1, wherein the first cellar trailer comprises an inner pair of bearing feet and an outer pair of bearing feet.

3. The method of claim 1, wherein the first well head is one of a row of well heads, and wherein the first cellar trailer is configured to skid parallel to the row of well heads to a next well head.

4. The method of claim 1, further comprising positioning a shear wall of the first cellar trailer between a ground surface and the drill floor to provide supplemental stiffening support to the drill floor of the drill rig.

5. The method of claim 1, further comprising, towing a second cellar trailer to second drilling site, the second cellar trailer comprising:

a second housing for storing well head equipment; and a second frame coupled to and supporting the second housing;

wherein, the second frame and the second housing are configured for removable placement over a second well head and below the drill floor of the self-supporting drill rig.

6. The method of claim 5, further comprising, positioning the second cellar trailer over the second well head and preparing the second well head for drilling operations prior to arrival of the self-supporting drill rig.

7. The method of claim 6, wherein positioning the second cellar trailer is performed while the drill rig is in position and performing drilling operations at the first well head and with the first cellar trailer.

8. The method of claim 7, further comprising moving the drill rig from the first well head to the second well head.

9. The method of claim 8, further comprising positioning the drill rig such that a substructure of the drill rig supports the drill floor in a cantilevered condition over the second cellar trailer.

10. The method of claim 8, further comprising closing down the first well head with the first cellar trailer.

11. The method of claim 10, wherein closing down the first well head is performed while the drill rig is performing drilling operations at the second well head with the second cellar trailer.

12. The method of claim 11, further comprising moving the first cellar trailer to a third well head and preparing the third well head for drilling operations while the drill rig is performing drilling operations at the second well head with the second cellar trailer.

* * * * *